US005190210A

United States Patent [19]

Walz

[11] Patent Number: 5,190,210

[45] Date of Patent: Mar. 2, 1993

[54] CONTINUOUS MAILING FORMS AND MAILING PREPARATION SYSTEM

[75] Inventors: Gerard F. Walz, Fallbrook, Calif.

[73] Assignee: Walz Postal Solutions, Inc., Fallbrook, Calif.

[21] Appl. No.: 406,732

[22] Filed: Sep. 13, 1989

[51] Int. Cl.[5] ..... B65D 27/06

[52] U.S. Cl. ..... 229/69; 229/92.8; 229/300; 283/81

[58] Field of Search ..... 229/69, 300, 74, 92.8; 283/62, 79, 81

[56] References Cited

U.S. PATENT DOCUMENTS

| | | | |
|---|---|---|---|
| 444,979 | 1/1891 | Harrison et al. . | |
| 3,304,103 | 12/1965 | Bensler et al. . | |
| 3,419,286 | 12/1968 | Noonan et al. . | |
| 3,507,519 | 4/1970 | McNabb . | |
| 3,655,121 | 4/1972 | Ward | 229/92.8 |
| 3,726,471 | 4/1973 | Kalb | 229/92.8 |
| 3,987,960 | 10/1976 | Gardiner | 229/74 |
| 3,993,299 | 11/1976 | O'Brien et al. | 270/5 |
| 4,029,341 | 6/1977 | Neill et al. | 283/81 X |
| 4,211,434 | 7/1980 | Reese . | |
| 4,213,639 | 7/1980 | Absler et al. . | |
| 4,230,262 | 10/1980 | Denay et al. | 229/69 |
| 4,236,731 | 12/1980 | Hektoen . | |
| 4,277,089 | 7/1981 | Lockhart | 283/81 X |
| 4,346,916 | 8/1982 | Shelton . | |
| 4,418,865 | 12/1983 | Bowen | 229/69 |
| 4,429,827 | 2/1984 | Murray | 229/68 |
| 4,493,496 | 1/1985 | Kaluza . | |
| 4,598,935 | 7/1986 | Stewart | 283/81 |
| 4,614,361 | 9/1986 | Foster | 283/81 X |
| 4,682,793 | 6/1987 | Walz . | |
| 4,928,874 | 5/1990 | Henry et al. | 229/74 |
| 4,995,642 | 2/1991 | Juszak et al. | 283/81 X |
| 5,020,830 | 6/1991 | Shishido | 229/92.8 X |
| 5,071,167 | 12/1991 | O'Brien | 283/62 X |

FOREIGN PATENT DOCUMENTS 2252792 6/1975 France .

OTHER PUBLICATIONS

IBM Technical Disclosure Bulletin of Eichorn, vol. 5, No. 4, Sep. 1962.

*Primary Examiner*—Stephen Marcus
*Assistant Examiner*—Jes F. Pascua
*Attorney, Agent, or Firm*—Brown, Martin, Haller and McClain

[57] ABSTRACT

An automated system for mail preparation and record keeping includes a data processor having a memory for storing program instructions and data including postage fees for different types of mailing, and a printer connected to a supply of continuous mailing forms which are separable along transverse tear lines and which conform to postal requirements for at least one type of tracked mailing. The processor is programmed to receive and store a list of names and addresses to whcih items are to be mailed, to compute the postage fees, and to print the names and addresses successively in designated addressee areas on successive forms in the form supply. The processor also keeps a record for each prepared form of the addressee, an article number provided on the form, and the postage fee.

7 Claims, 11 Drawing Sheets

CONTINUOUS MAILING FORMS AND MAILING PREPARATION SYSTEM

BACKGROUND OF THE INVENTION

The present invention relates generally to mailing forms and procedures as used for keeping track of mailed items for insurance purposes, for confirmation of delivery to a customer, and/or for record keeping purposes. Some mailing procedures with which this invention is particularly concerned are known as certified and registered mail.

In any business a large number of items and/or correspondence is mailed to customers on a daily basis. Some, if not all, of these mailings must be tracked for various reasons, for example for insurance purposes in the case of items of value. The paperwork needed to keep track of business mailings via certified or registered mail, or even simply to record standard mailings, is lengthy and tedious to complete, particularly in the case, of large businesses with bulk mailings on a daily basis.

In my U.S. Pat. No. 4,682,793, a continuous mailer form is described which is particularly designed to meet Post Office certified mail requirements. The multiple layers of the form include all the paperwork required for simultaneous completion of a mailing label, customer receipt, and return receipt for each item mailed. Thus, all the paperwork required for each item to be mailed on a particular occasion can be filled out in one pass simply by running the continuous form through a computer printer or typewriter and entering the respective customer addresses on each form, detaching the forms on completion and attaching the mailing address, item identification number (e.g. the certified mail number), and return receipt to the respective items to be mailed.

However, even this procedure still requires a relatively large amount of manual paperwork to compute postage, to keep records of mailings and receipt numbers, and to track when receipts are returned. The current process for preparing registered or certified articles for mailing, and for other types of mail tracking procedures, requires the typing, handwriting or computer generation of an address label which typically includes at least the addressee's name and address, as well as an identifying file number. This label is then attached to the article to be mailed, either by affixing it to the exterior of the article or as an insert into a window envelope. In the case of registered or certified mail, the Postal Service approved label carrying the certified or registered mail number must also be affixed to the package. The same identifying number must be entered by the user on the return postcard, either by hand or using a typewriter. The type of service (certified, registered, insured, etc.) must also be checked off on the return postcard, and the addressee section completed. Finally, the return address must be entered on the reverse side of the postcard before affixing it to the item to be mailed. The sender must also prepare the paperwork required both for internal record keeping and to satisfy Postal Service requirements. This includes the addressee, type of mailing, actual value, postage, and identifying number for each item mailed. This is typically done by hand, which is a lengthy and tedious procedure and often gives rise to errors, potentially resulting in loss of coverage if the item should be lost.

SUMMARY OF THE INVENTION

It is an object of this invention to provide an improved mailing form and automated mailing preparation procedure.

According to a first aspect of the present invention, a continuous mailing form is provided which comprises a continuous sheet of individual return receipt form parts secured together along spaced transverse tear lines, the sheet having lines of pin feed perforations extending along its opposite outer marginal side edges, each individual form part having spaced longitudinal tear lines for separating a predetermined detachable area of form part from the remainder of the form for attachment to an item to be mailed, the predetermined detachable area comprising a return postcard and having printed indicia on both of its faces including marked areas for receiving predetermined information concerning a mailed item, one of said areas on a first face of the return postcard comprising a designated addressee area for receiving the address to which the item is to be mailed, and a blown-on label detachably secured to the designated addressee area for receiving address information and for reproducing any information imprinted on it onto an underlying addressee area on the return postcard. The blown-on label is preferably of the known peel off, "self-imaging" type comprising a two layer label including a bottom layer adhesively securable to an underlying sheet, and a top, peel off layer detachably secured to the underlayer and comprising a carbonless type of copy paper which will transfer any information imprinted on it onto the bottom layer, which remains on the return postcard when the top layer is detached to identify the article addressee. Once the addressee information has been imprinted on the blown-on label of a series of forms, the respective individual forms or form parts can be detached and the upper layer of the label detached for securing to the item to be mailed. At the same time, the return postcard itself is attached elsewhere to the item to be mailed via suitable lines of adhesive provided on the reverse side of the card where the return address of the sender is imprinted. The return card itself may be separable from the adhesive lines via suitable additional tear lines.

Preferably, each individual form also carries an item identifying number, such as a registered or certified mail number, for example, which may be imprinted at a suitable location on the return postcard and also provided elsewhere on the form in the form of a detachable label for attachment to the article to be mailed.

In this way, all the parts needed for registered or certified mailing, or other forms of mail tracking, may be provided in a single layer form which is easily detached from successive forms in the assembly. If a sender receipt is desired, an additional sheet may be adhesively attached to the basic sheet along one marginal side edge, with a designated address area in registry with the designated address area on the underlying return receipt form.

According to another aspect of the present invention, an automatic mailing procedure or system is provided for mailing items and keeping track of mailings. The procedure comprises receiving and storing a series of names and addresses, printing each address in series on successive individual mailing forms of a continuous mailing form, each individual form having a label for attachment to an article to be mailed, and a return postcard also for attachment to the article being mailed for return to the sender as confirmation of receipt, the return postcard having a designated address area in registry with the designated address area on the label for simultaneously receiving an imprint of the designated name and address, each return postcard also having a designated area for carrying an identifying code for identifying each item, storing the name and address imprinted on each form along with the identifying code previously imprinted on the form, and printing a listing of all names and addresses entered along with the associated identifying numbers. Preferably, the system also allows the user to update the stored records whenever a return postcard or mailed item is returned, and to prepare various types of reports, including reporting returned items and types of returns, and returns listing any items for which no return has been received. The procedure preferably also includes the steps of entering the postal value (i.e. the weight and value of each item to be mailed), entering the type of mailing desired, and automatically calculating the postal fee for each item. This fee will then be stored along with other required identifying information and will be printed in the final listing or report of items to be mailed.

This system considerably speeds up both the mailing, record keeping and tracking procedures for several different types of mailing. Once the sender has entered a series of addressee names and addresses, either via a keyboard or via retrieval from a previously stored local or remote database, and the required information for computing the postage required for each item..(typically its weight and insurance value, and the type of mailing required), the system automatically calculates the postage fee for each item , and can then prints a series of forms on the selected continuous mailing form. Preferably, at least two different types of mailing form are provided in a continuous format, for example forms for either certified or registered mail, and can be loaded manually by the user into a single printer or pre-loaded in different printers so that the appropriate printer can be selected either manually or automatically by the system. Each individual form in the continuous forms will carry the required mailing label with an appropriate identifying number for postal purposes, for example the certified or registered mail number, which identifying number is also pre-printed on the return postcard of that form. When printing a series of forms, the user simply enters the first article number of the forms to be used, and the computer will assign that number to the first address printed, and assign numbers consecutively to the following addresses or records printed. If insufficient forms are available in the supply to complete a required printing cycle, the user also enters the last article number in the available supply, allowing a new supply, which may not be consecutively numbered, to be loaded when needed. If a printing problem is encountered, the user enters the first "incorrectly printed" article number as well as the first number of the reloaded supply. The system will automatically track and associate each addressee with the article number on the form on which that addressee's address is printed, and will store that information for future reference. The forms may also be provided pre-printed with the sender's address. The user can obtain a report, which may be in the format required by the post office for mail tracking purposes, of all the mailings with the article number of each mailing listed along with the addressee, postage values and fees as required, and a space for the postal officer to acknowledge deposit of the item for mailing.

It can be seen that this procedure considerably reduces the paperwork and time required for preparing items for mailing, keeping records of mailings, and tracking receipt of mailed items. All of the labels required for specific types of mailings, such as certified or registered mail, are provided on a single form in a continuous format, which also includes the required return postcard for additional confirmation of receipt which may be previously imprinted with the respective article number. The sender simply has to enter a sequence of addressee information for a plurality of items to be mailed, along with the information required to compute the postal fee, and can then print a series of forms. The sender then takes the forms, separates them into individual forms, and separates the address label and article identifying number label from each form and affixes them both to the respective article to be mailed. The return postcard is then also taken and affixed to the article. No entering of names and addresses and/or article numbers on the article or return postcard, or in a record keeping logbook, is needed. Instead, the system itself automatically stores the required information and can print the information in the form of a report whenever required. Various different types of reports may be obtained, for example reports indicating articles for which the return postcard has not been returned, as well reports indicating the type of return in the case where some return from a mailing has been received(for example, the article itself may have been returned as unclaimed, wrong address, and so on). This automated system considerably reduces mail processing time, reducing manpower requirements and expense.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENTS

Figure 1:
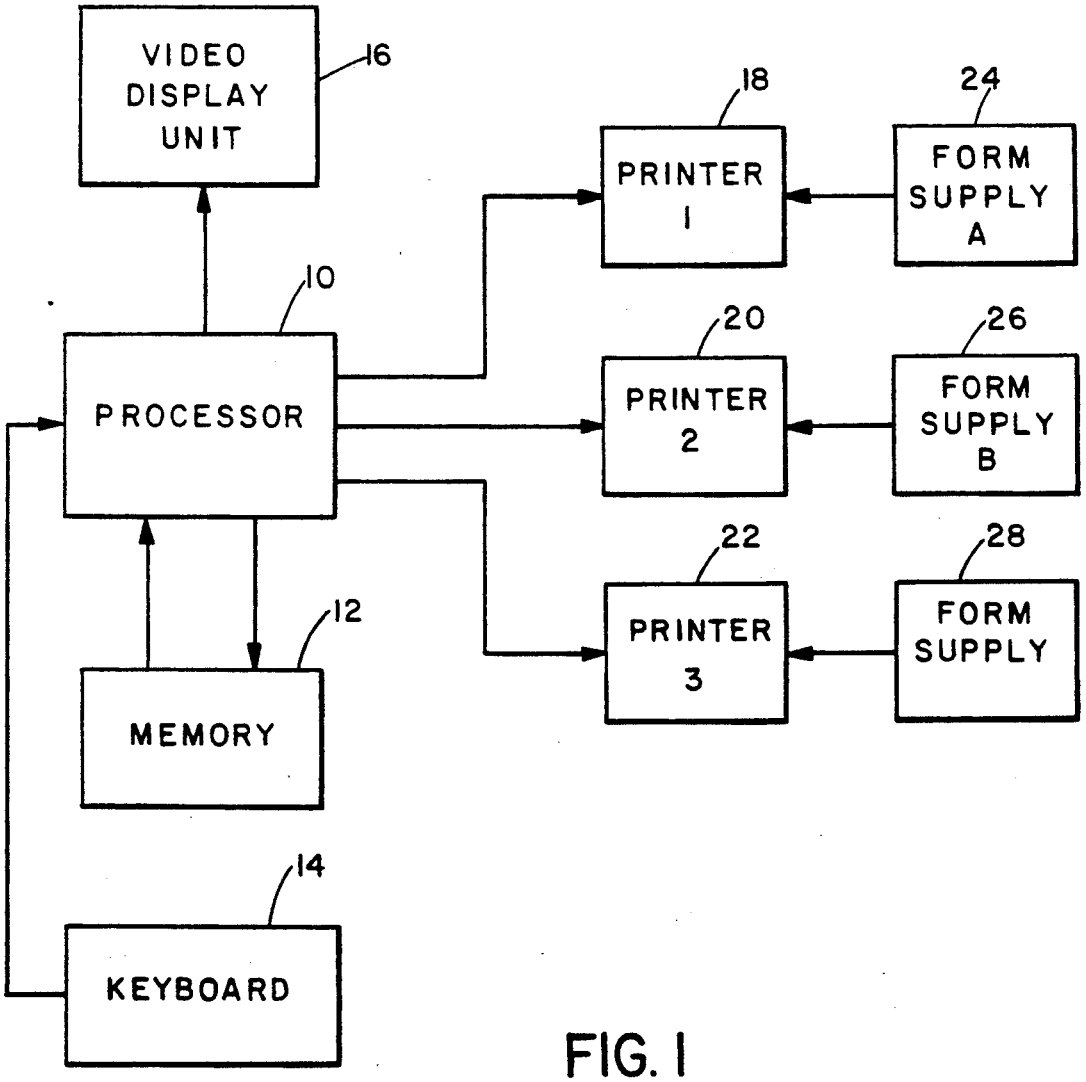
FIG. 1 is a block diagram of a mail preparation, recording, and tracking system according to a preferred embodiment of the present invention.

FIG. 1 schematically illustrates the basic hardware components required for mail preparation, record keeping and tracking system according to a first embodiment of the present invention. The system is operated by suitable programming in order to perform the required functions as illustrated in the flow diagrams of FIGS. 8 to 14, as will be explained in more detail below. The system is used in conjunction with one or more different types of continuous mail forms for providing the necessary address and other labels for attaching to items or packages to be mailed. These forms may be of the types illustrated in FIGS. 2 to 7, for example, and/or of other types such as that described in U.S. Pat. No. 4,682,793 of Walz.

The system basically comprises a computer including a processor 10 and associated memory 12, a keyboard 14 for operator input, a video display unit or CRT 16, and one or more printer units 18,20,22 connected to the computer for printing information on one or more different types of continuous mailing form and for printing reports of various types. In the embodiment illustrated in FIG. 1, the computer is shown linked to three separate printer units each of which is provided with a supply 24,26,28 of a different type of continuous form. For example, form supplies 24, 26 may comprise continuous forms for two different types of mailing, such as certified and registered mail, for example, while supply 28 may comprise blank continuous form-feed paper or continuous forms for report printing, such as a facsimile of the type of report form required by the Post Office for listing certified or registered mailing identifying numbers along with the respective addressee and other required information. Instead of separate printer units as illustrated in FIG. 1, a single printer unit may be used with the operator changing the supply of forms between the different types available as needed.

Figure 2:
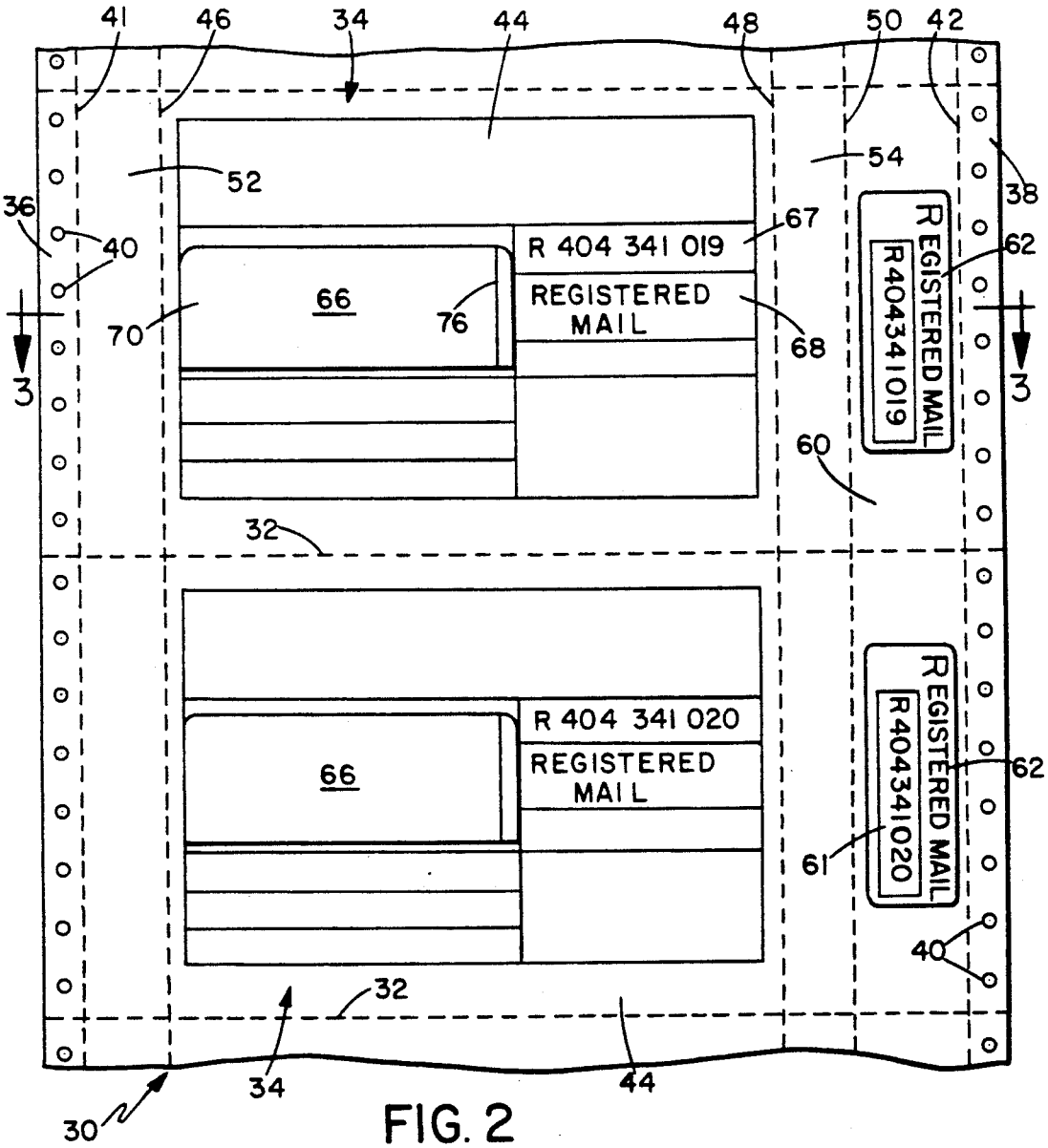
FIG. 2 is front elevational view of a length of a first type of continuous mailing form according to another aspect of the present invention for use in the system of FIG. 1.
Figure 3:
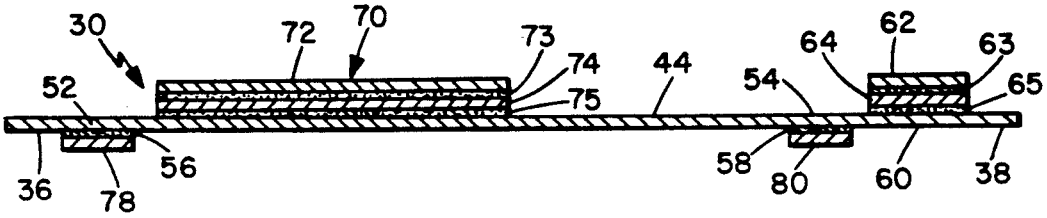
FIG. 3 is an exploded cross-section through the form on the lines 3—3 of FIG. 2.
Figure 4:
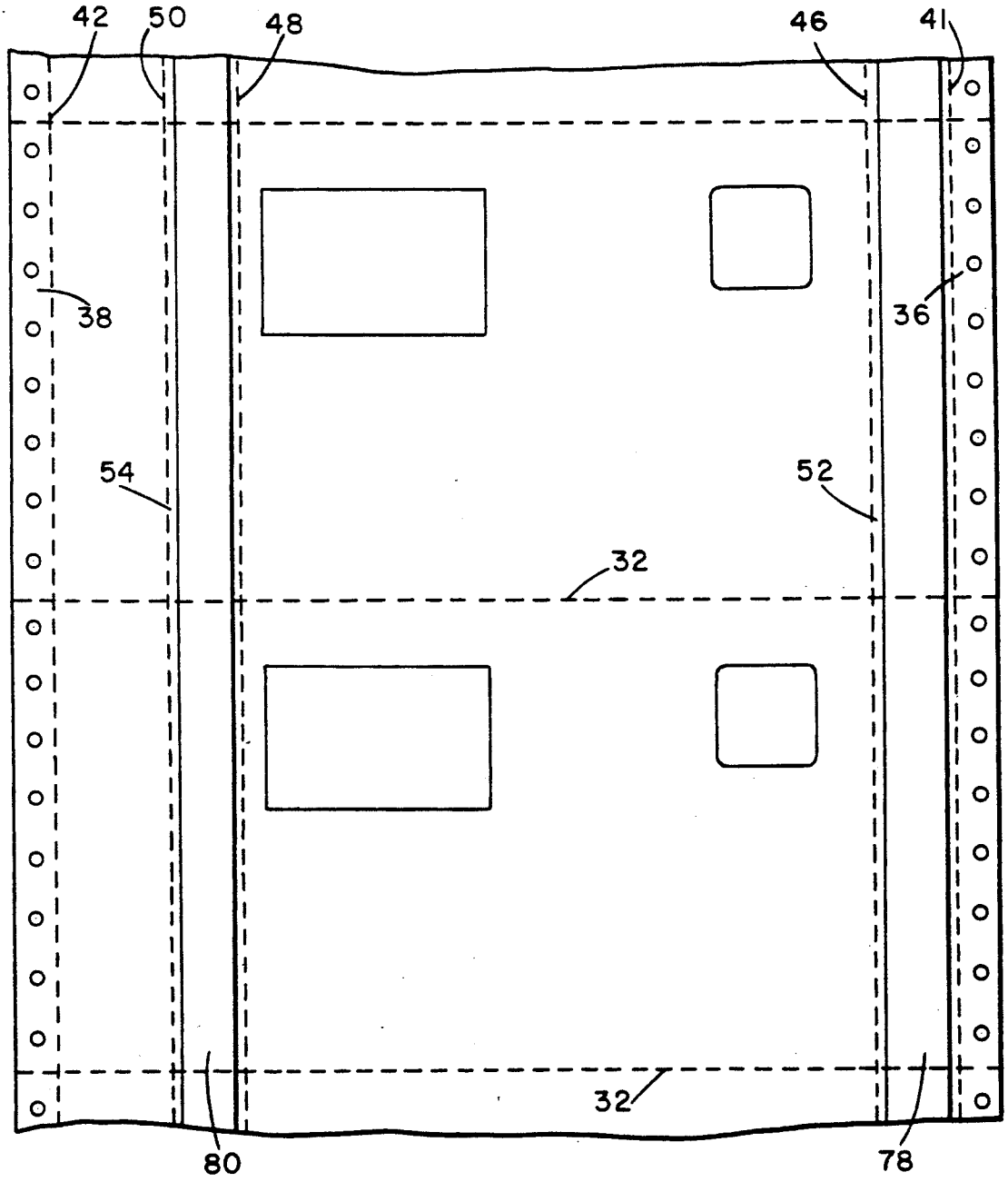
FIG. 4 is a rear elevational view of the form of FIG. 2.

In U.S. Pat. No. 4,682,793 of Walz, a continuous mailer form assembly particularly suitable for certified mailing procedures was described. This type of form may be utilized with the system illustrated in FIG. 1. Additionally, or alternatively, a continuous one sheet form 30 as illustrated in FIGS. 2 to 4 may be provided. This form is suitable both for use in the system as illustrated in FIG. 1 and FIGS. 8 to 14, and for use on its own in conjunction with standard manual record keeping techniques.

The one layer continuous form 30 illustrated in FIGS. 2 to 4 is particularly designed for registered mailing procedures. However, the form may be alternatively designed for certified mailing or other types of mail tracking, for example as a simple return receipt for merchandise.

The single layer of the form 30 is of a card material such as that used by the Post Office for return receipts (e.g. PS Form 3811). The form 30 has a series of equally spaced, transverse tear lines 32 for separating the form into individual form lengths or parts 34. Each form length corresponds to the length of a standard Post Office return postcard or receipt. The opposite outer marginal side edges 36,38 of the form are provided with lines of pin feed perforations or socket holes 40 arranged to allow the form to be fed continuously through the standard tractor feed of various data processing machines such as printers with the perforations engaged on the feed pins or drive spindles of the printers. The width of the form is therefore equivalent to the width of standard paper used in such printers. Longitudinal tear lines 41,42 are provided adjacent the marginal side edges to allow the individual form lengths to be separated from the marginal edge portions carrying the pin feed perforations.

Each form length or part has a central portion 44 comprising a return receipt or postcard which is preferably of a type similar or equivalent to that used by the Postal Service for the type of mailing for which the form is intended. In the embodiment illustrated, the return receipt is designed for registered mail and is of the same dimensions as U.S. Post Office PS Form 3811. However, it may alternatively be designed for certified or other types of mailing. Additional spaced longitudinal tear lines 46,48,50 are provided for separating the central area or return receipt portion 44 from the remainder of the individual form part, and for separating side edge strips 52,54 of the portion 44 which carry self adhesive strips 56,58 (see FIGS. 3 and 4) from the remainder of portion 44. An additional portion or strip 60 of the form which remains after the return receipt portion is detached along tear line 50 carries a continuous series of labels 62, one per form length, carrying identifying indicia 61 for identifying specific mailed items according to Post Office requirements, for example. In the embodiment illustrated, the labels 60 are designed for registered mail and carry a continuous numbered sequence of successive registered mail numbers, which are printed according to Post Office format requirements, which currently require OCR-A type letter format for registered mail number labels. The labels 60 in the illustrated embodiment are of the red U.S. Postal Service "Label 200" type, and have adhesive backings 63 releasably securing them to a backing layer or strip 64 which is secured to the underlying portion of the form by any suitable adhesive 65, such as double sided adhesive tape strips. The labels 60 can be peeled off the backing layer for securing to a series of items to be mailed when desired.

The front face of the return receipt portion 44 of each form part is imprinted with predetermined indicia including a number of blocks for entry of appropriate information as is normally required in a standard mailing procedure such as registered mailing. One of the blocks 66 defines an area for entry of the addressee information, while another block 67 is pre-printed with the same identifying indicia or number as label 60 alongside that particular receipt portion. Block 68 is preprinted to identify the type of mailing (for example registered mail as illustrated, or alternatively certified mail or other types of mailing procedures). Other blocks are provided for completion on receipt by the addressee prior to mailing the card back to the sender.

Each block 66 defining the area for receiving addressee information is provided with a self-imaging, blown-on label 70 of appropriate dimensions on which the addressee information can be imprinted to provide both an article address label and the required addressee information on the return postcard. As best illustrated in FIG. 3, blown-on label 70 is in two parts, including a peel off upper part 72 which is adhesively secured via suitable adhesive 73 to an underlying, self imaging lower part 74. The lower part is secured to the appropriate area 44 of the return receipt portion of a respective form length by a suitable adhesive 75, such as double sided adhesive tape. The lower part is of a known self imaging material which will reproduce any information imprinted on the upper part, such as carbonless copy paper of which NCR paper is typical. A score line 76 is provided adjacent one side edge of the upper part of label 70 to aid in peeling off the upper part from the lower part.

The rear face of the return receipt portion 44 can be seen in FIG. 4. It includes self-adhesive strips 56,58 extending along its opposite marginal side edges outside tear lines 46,48, and covered by strips 78,80 of a suitable cover material for protective purposes. The area inside tear lines 46,48 carries return address information, which may be pre-printed, and a marked stamp area as well as other instructional information if desired.

The continuous mail form is utilized by first feeding it into a suitable printer unit or typewriter. It may be utilized in the system of FIGS. 1 and 8 to 14 for automatically printing a series of previously entered or programmed names and addresses sequentially on the labels 70 of successive form lengths of the continuous form, or alternatively the operator may successively enter the required addressee information using a typewriter or data processor. Once the required number of form lengths has been completed with the desired addressee information, the completed form parts are separated into individual form lengths via tear lines 32. In order to prepare each item or package for mailing, the upper part of label 70 is peeled off and attached to the item as the address label, and the identifying number label 62 on strip 60 is similarly peeled off and attached at an appropriate location on the package. The return receipt portion is detached along tear lines 41 and 50 from the left hand side pin feed portion 36 and from the side portion 60 which carried the number label 62. The detached portions 36 and 60 can be discarded, while portion 44 is secured to the package by adhesive strips 56,58. The return receipt portion will already carry the addressee information on the lower part of label 70, so no manual entries are required on portion 44. Once the correct postage has been applied, the item is ready for mailing.

When the addressee receives the item, the postal officer or deliverer simply detaches the return receipt from the packaging via tear lines 46 and 48, signs their name in the appropriate block, and has the addressee sign at the appropriate location before returning the card to the sender.

Figure 5:
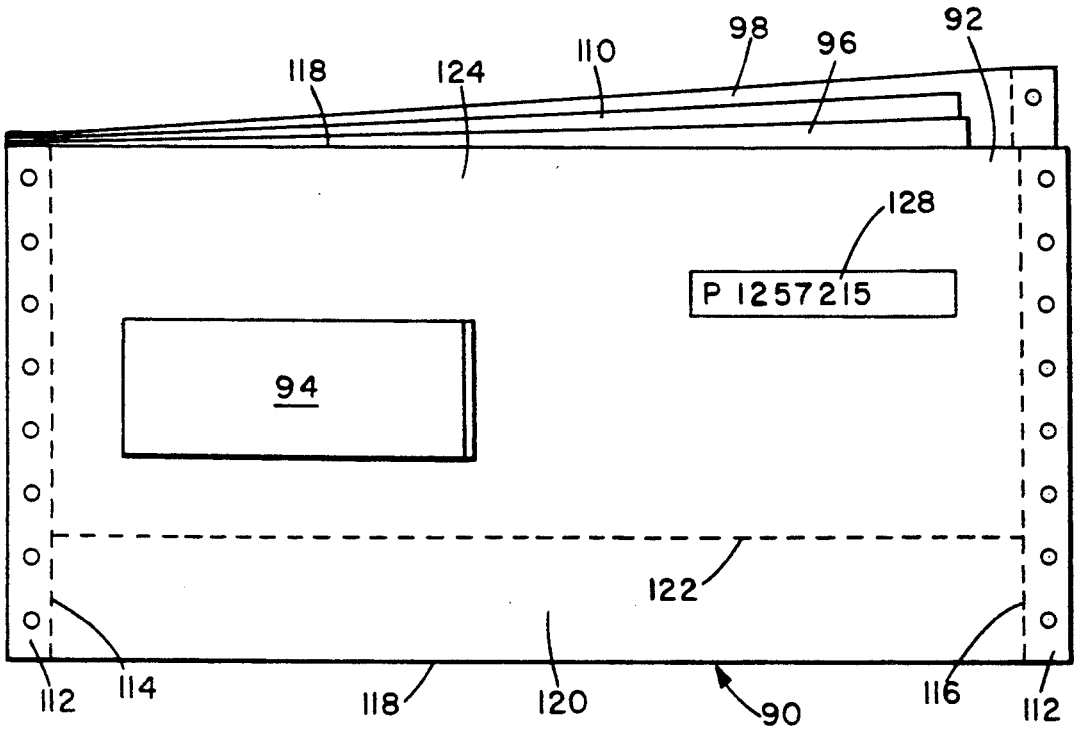
FIG. 5 is a perspective view of a length of a second type of continuous mailing form for use in the system of FIG. 1.
Figure 6:
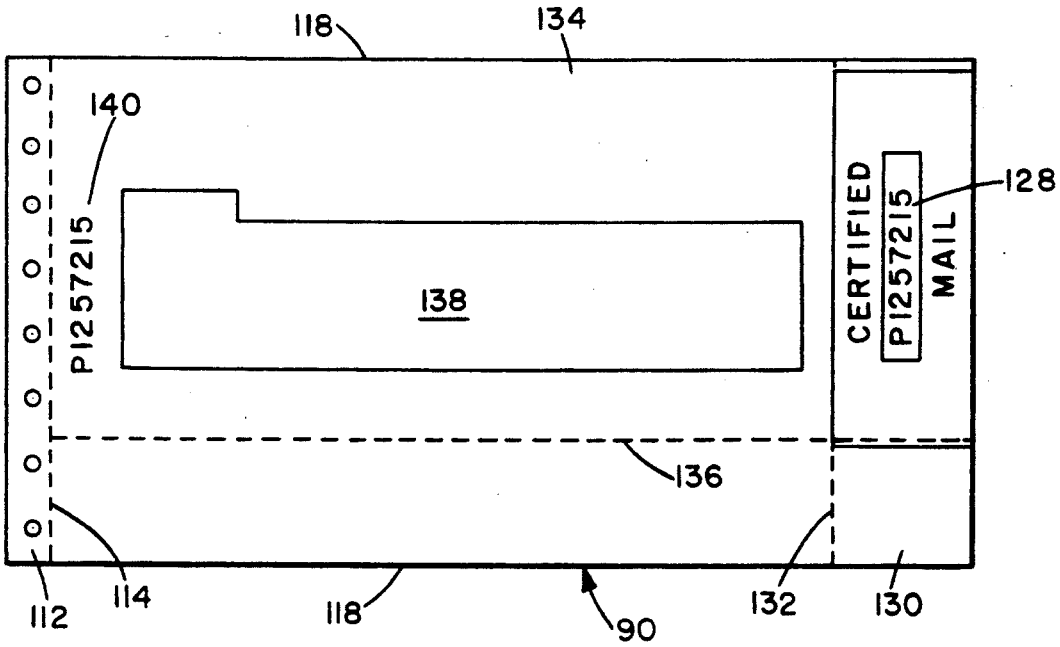
FIG. 6 is a front elevational view of an inner sheet of the form of FIG. 5.
Figure 7:
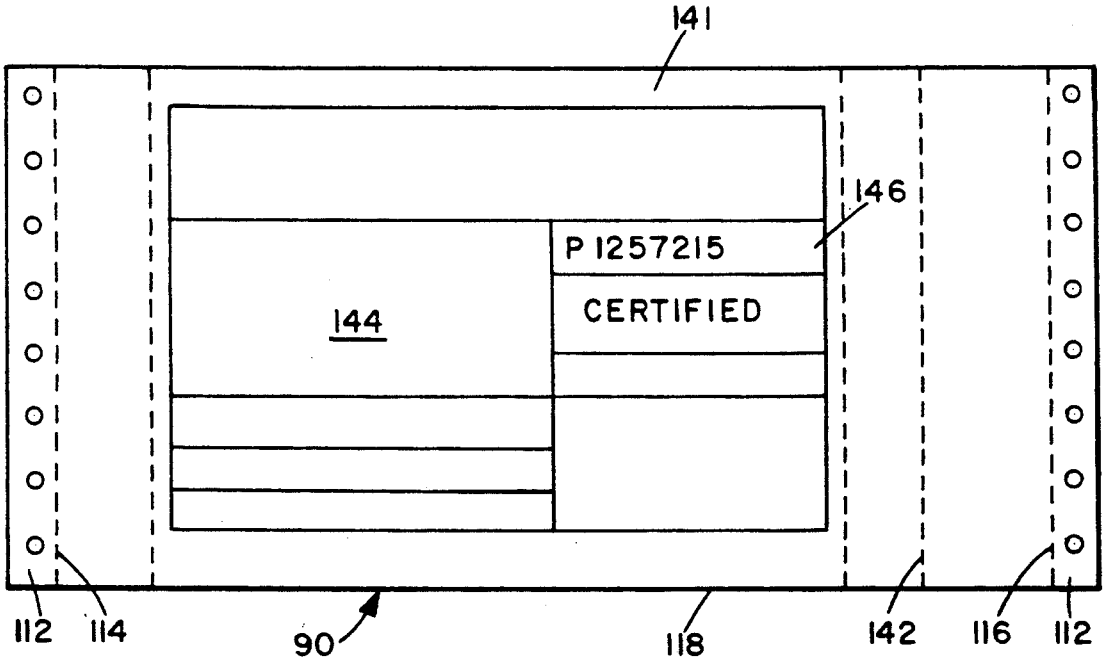
FIG. 7 is a front elevational view of the rear sheet of the form of FIG. 5.
Figure 8:
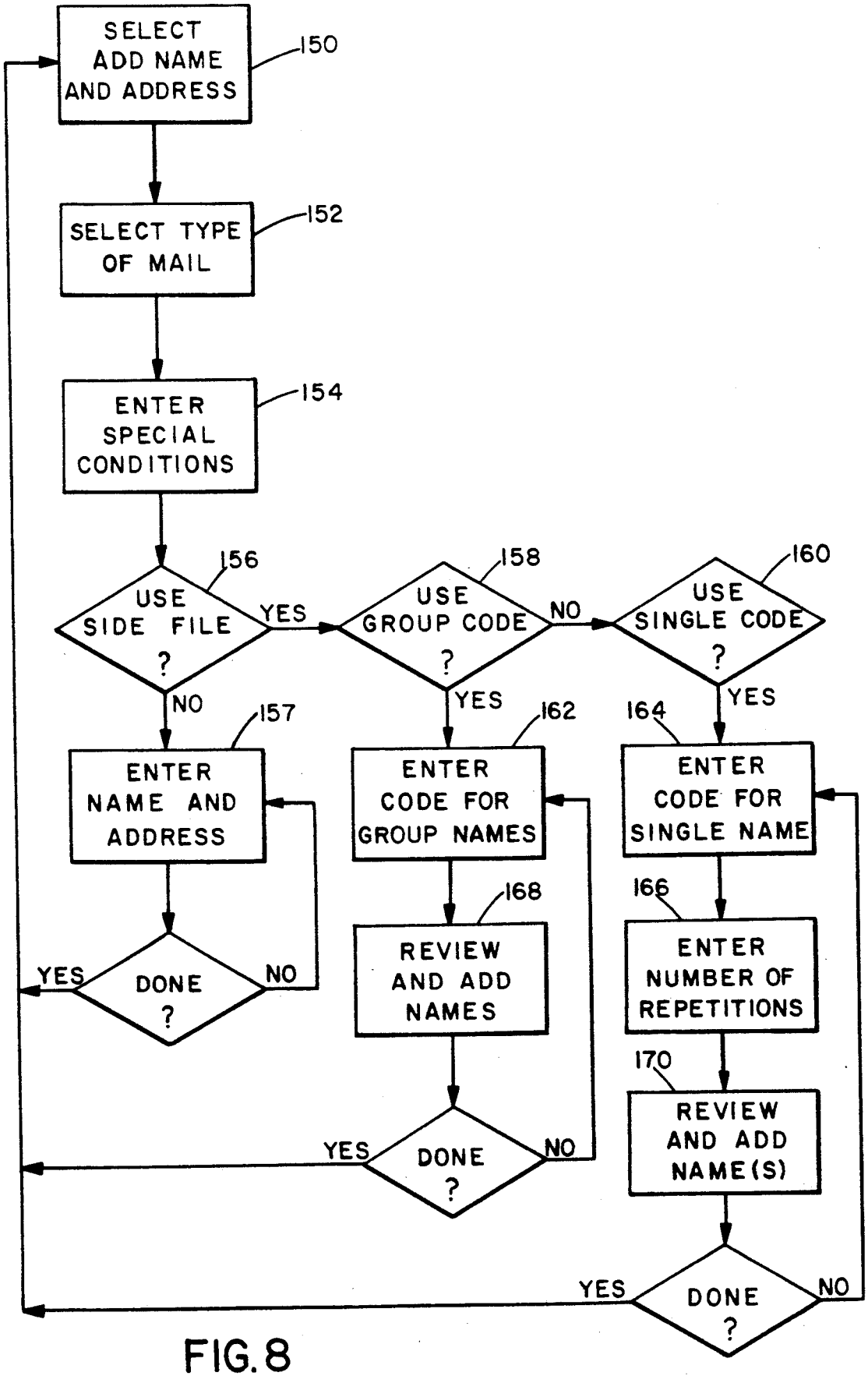
FIGS. 8 through 14 are detailed flow diagrams of the system.

Another continuous mailing form 90 is illustrated in FIGS. 5 to 7. This form is a multi-sheet form instead of a single sheet form as in FIGS. 2 to 4, and includes a front sheet 92 carrying a mailing label 94 of the same blown-on, self-imaging type as label 70 in the previous embodiment, an intermediate sheet 96 comprising a sender's receipt or proof of mailing type form, and a rear sheet 98 which incorporates a return receipt or postcard of a similar type to that utilized in the form of FIGS. 2 to 4. A sheet 110 of carbon paper may be provided between the intermediate and rear layers, or alternatively these layers may be of the carbonless copy type so that information imprinted on the front sheet is transferred to the underlying layers. The form illustrated in FIGS. 5 to 7 is particularly designed for certified mailing procedures, although it may alternatively be designed of other types of mailing.

The successive sheets of the form are secured together by adhesive along one marginal side edge, and the front and rear sheets, which are of equivalent width, are provided with lines of pin feed perforations 112 along their opposite marginal side edges which can be separated from the remainder of these sheets via longitudinal tear lines 114,116. Spaced transverse tear lines 118 which extend through all the sheets of the form allow the form to be separated into individual form lengths or parts 120. Each form length of the front sheet carries an additional transverse line of perforations 122 for separating out a portion 124 of the form carrying address label 94. Portion 124 is dimensioned for fitting in a standard window envelope if desired, or alternatively may be used for record keeping purposes with the peel-off upper part of label 94 peeled off and attached to the item to be mailed. As in the previous embodiment, label 94 is of the two-part, self-imaging type so that when the upper part is detached, the underlying part, which will be imprinted with any information applied to the upper part, will remain attached to portion 124. Portion 124 is also pre-printed with an identifying code or number 128, for example a certified mail number or other code for identifying a specific item of mail.

The intermediate layer of a form length of the multipart continuous form is illustrated in FIG. 6, and comprises a side strap portion 130 detachable from the remainder of the form length via longitudinal tear line 132 and imprinted with the same identifying code 128 as the remainder of the form. The strip has adhesive on its rear face covered with a peel off cover sheet (not illustrated) so that it can be detached and secured to a package. The intermediate layer also includes a sender's receipt portion 134 for receiving a postmark as the sender's proof of mailing, which may be equivalent to Post Office Form 3800, for example, as illustrated in the drawing. Receipt portion 134 is detached from the remainder of the form layer via additional transverse tear line 136 as well as longitudinal tear lines 114 and 132. It includes an addressee information area 138 which is in registry with the address label area of the front sheet when the two sheets are secured together along their left hand side margin. The sender's receipt is also imprinted with the same identifying number as the side strip and the front sheet, in area 140.

The rear sheet of the form is illustrated in FIG. 7 and is similar to the single sheet form length of FIGS. 2 to 4 in that it includes a return receipt portion 141 similar to a standard Post Office return receipt card (PS Form 3811) detachable from the remainder of the form length of each rear sheet via tear lines 114 and 142. The return receipt portion includes pre-printed blocks for receiving similar information to the return receipt portion of the form of FIGS. 2 to 4, including an addressee area 144 which is blank, and an article number area 146 which is pre-printed with the same article identifying number as the front and intermediate sheets. The addressee area is positioned for registry with the address area on the front sheet and intermediate sheets. The rear face of return receipt portion 141 will be identical to that of the return receipt portion of the alternative form illustrated in FIG. 4.

Both the single sheet continuous form of FIGS. 2 to 4 or the multi-sheet form of FIGS. 5 to 7 may be provided in alternative versions designed for various alternative types of mailing, for example registered, certified, merchandise delivery receipt, etc. The single layer form of FIGS. 2 to 4 has the advantage of reduced thickness and reduced paperwork. In each case, the continuous forms may be incorporated in a mailing procedure utilizing an existing manual record keeping system. However, in the preferred embodiment of the invention an automated mail preparation, record keeping and tracking system is provided in which one or more continuous mailing forms of the type described in U.S. Pat. No. 4,682,793, or as illustrated in FIGS. 2 to 7 are automatically prepared and corresponding records stored for subsequent printing of reports as required by the Post Office and also as desired by the user of the system for tracking purposes.

FIGS. 8 to 14 of the drawings are flow diagrams illustrating how the system of FIG. 1 is operated according to program instructions stored in its memory in order to perform the desired computation, printing, record keeping and report preparing functions. Table 1 is a listing of one suitable program for performing the steps illustrated in FIGS. 8 to 14. The program in Table 1 has been written in Nantucket Clipper language. The program is made up of several modules which are listed below according to their source code file names.

1. MAILINGS.PRG
2. CERTADDN.PRG
3. CERTFIND.PRG
4. UPDTMAIL.PRG
5. CERTPRNT.PRG
6. PRNT3877.PRG
7. LISTPRNT.PRG
8. RECTPRNT.PRG
9. DETLPRNT.PRG
10. RETNPRNT.PRG
11. CODEMAIL.PRG
12. RETNCODE.PRG
13. DELEMAIL.PRG
14. INSRFEES.PRG
15. FINDNAME.PRG

```
*****************************************************************************
* MENU.PRG - RECONVEYANCE MENU SYSTEM                                       *
*****************************************************************************
SET SCOR OFF
SET COLO TO W+/B
CLEAR
TEXT

                    WALZ POSTAL SOFTWARE
                     (c) COPYRIGHT 1989

                        VERSION  2.0

                 THIS PROGRAM IS THE PROPERTY OF:

                    WALZ POSTAL SOLUTIONS, INC.
                 1139 S. MISSION ROAD, SUITE C
                      FALLBROOK, CA 92028
                        (619) 728-0565

                       ** N O T I C E **

    E LEGAL BUYER OF THIS SOFTWARE IS GRANTED A PERPETUAL LICENSE TO USE
  THE  SOFTWARE  ON  ONE  MACHINE  BY ONE PERSON AT A TIME.   SUBSEQUENT
  LICENSES  MUST  BE  PURCHASED  TO  RUN  THIS SOFTWARE ON MORE THAN ONE
  MACHINE.   IT IS A  VIOLATION OF COPYRIGHT LAWS TO MAKE A COPY OF THIS
        SOFTWARE FOR ANY PURPOSE WHATSOEVER, EXCEPT AS A BACKUP.

ENDTEXT
@ 1,0 TO 24,79 DOUBLE

DUM = " "
@ 23,26 SAY "PRESS ANY KEY TO CONTINUE " GET DUM
READ

RCOMP_NAME  = SPACE(40)
RCOMP_ADDR  = SPACE(35)
RCOMP_CITY  = SPACE(20)
RCOMP_STATE = "  "
RCOMP_ZIP   = SPACE(10)
RCOMP_PHON  = SPACE(13)
RREG_MAIL   = 0
RR_FEE      = 0
RCERT_FEE   = 0
RREG_FEE    = 0

IF FILE("COMP.MEM")
   RESTORE FROM COMP ADDITIVE
ENDIF

MOPER = SPACE(5)
MDEPT = SPACE(8)
```

```
MSCERT = SPACE(10)
MECERT = SPACE(10)
MCOMP = TRIM(RCOMP_NAME)
level1 = 1  && memvar for menu levels
level2 = 1
level3 = 1
level4 = 1
level5 = 1
DO WHILE (level1 # 0)
   DO SCRNHEAD
   CLOSE ALL
   SET MESSAGE TO 20 CENTER   && display MESSAGEs on line 20
   @ 22,10 to 24,69
   @ 23,12 SAY "Use <- -> or first letter of command, press ESC to EXIT."
   @ 07,32 SAY "MAILER MAIN MENU"
   @ 08,12 to 10,68

   *ADD     CHANGE    RETURNS    PRINT    UTILITIES
   *17      24        34         45       54

   @ 09,17 PROMPT "ADD"        MESSAGE "Add New Mail Names"
   @ 09,24 PROMPT "SEARCH"     MESSAGE "Search/Change Existing Mail Names"
   @ 09,34 PROMPT "RETURNS"    MESSAGE "Update Return Receipt Date"
   @ 09,45 PROMPT "PRINT"      MESSAGE "Print Green Cards and Reports"
   @ 09,54 PROMPT "UTILITIES" MESSAGE "System Utilities"

   MENU to level1

   DO CASE
   CASE level1 = 0
      * EXIT
      DO SCRNHEAD
      OUT = .T.
      @ 09,15 to 15,65
      @ 10,18 SAY "Thanks for using the Walz certified mail system"
      @ 12,22 SAY "It's been pleasant working with you!"
      @ 14,24 SAY "Are you sure you want to EXIT?" GET OUT PICT "Y"
      READ
      IF OUT
         QUIT
      ENDIF
      CLEAR
      level1 = 1
      LOOP

   CASE level1 = 1
      *ADD
      *1- CERTIFIED NAMES
      *2- REGISTERED INSURED NAMES
      *3- REGISTERED UNINSURED NAMES
      *4- C.O.D. NAMES
      level2 = 1
      DO sub_menu WITH level1
      DO CASE
      CASE level2 = 1
         SCRLABEL = "ADD CERTIFIED MAIL NAMES"
         MMAIL_TYPE = "1"
         do CERTADDN
      CASE level2 = 2
         SCRLABEL = "ADD INSURED REGISTERED MAIL NAMES"
         MMAIL_TYPE = "2"
         do CERTADDN
      CASE level2 = 3
         SCRLABEL = "ADD UNINSURED REGISTERED MAIL NAMES"
         MMAIL_TYPE = "3"
         do CERTADDN
      CASE level2 = 4
         SCRLABEL = "ADD C.O.D. MAIL NAMES"
```

```
      MMAIL_TYPE = "4"
      do CERTADDN
   ENDCASE
   CLEAR

CASE level1 = 2
   *CHANGE
   *1- CERTIFIED NAMES
   *2- REGISTERED INSURED NAMES
   *3- REGISTERED UNINSURED NAMES
   *4- C.O.D. NAMES
   level2 = 1
   DO sub_menu WITH level1
   DO CASE
   CASE level2 = 1
      MLABL = "CHANGE/SEARCH CERTIFIED"
      SCRLABEL = "CERTIFIED NAMES"
      MMAIL_TYPE = "1"
      DO CERTFIND
   CASE level2 = 2
      MLABL = "CHANGE/SEARCH INSURED REGISTERED"
      SCRLABEL = "INSURED REGISTERED NAMES"
      MMAIL_TYPE = "2"
      DO CERTFIND
   CASE level2 = 3
      MLABL = "CHANGE/SEARCH UNINSURED REGISTERED"
      SCRLABEL = "UNINSURED REGISTERED NAMES"
      MMAIL_TYPE = "3"
      DO CERTFIND
   CASE level2 = 4
      MLABL = "CHANGE/SEARCH C.O.D."
      SCRLABEL = "C.O.D. NAMES"
      MMAIL_TYPE = "4"
      DO CERTFIND
   ENDCASE
   CLEAR

CASE level1 = 3
   *UPDATE MAIL DATES AND RETURN DISPOSITION
   DO UPDTMAIL

CASE level1 = 4
   *PRINT
   *1- FORMS
   *2- REPORTS
   level2 = 1
   DO sub_menu WITH level1
   DO CASE
   CASE level2 = 1
      *FORMS
      *1- CERTIFIED MAIL GREEN CARDS
      *2- FIRM BOOK FORM 3877
      *3- REGISTERED INSURED FORMS
      *4- REGISTERED UNINSURED FORMS
      *5- C.O.D FORMS
      DO sub_prnt WITH level2
      DO CASE
      CASE level3 = 1
         SCRLABEL = " PRINT CERTIFIED MAIL "
         MMAIL_TYPE = "1"
         do CERTPRNT
      CASE level3 = 2
         do PRNT3877
      CASE level3 = 3
         SCRLABEL = " PRINT INSURED REGISTERED MAIL "
         MMAIL_TYPE = "2"
         do CERTPRNT
      CASE level3 = 4
```

```
            SCRLABEL = " PRINT UNINSURED REGISTERED MAIL "
            MMAIL_TYPE = "3"
            do CERTPRNT
         CASE level3 = 5
            SCRLABEL = " PRINT C.O.D. MAIL "
            MMAIL_TYPE = "4"
            do CERTPRNT
         ENDCASE
      CASE level2 = 2
         *REPORTS
         *1- ALL NAMES LISTING REPORT
         *2- UNRETURNED GREEN CARDS REPORT
         *3- POSTAGE FEE DETAIL REPORT
         *4- RETURN DISPOSITION REPORT
         DO sub_prnt WITH level2
         DO CASE
         CASE level3 = 1
            do LISTPRNT
         CASE level3 = 2
            do RECTPRNT
         CASE level3 = 3
            do DETLPRNT
         CASE level3 = 4
            do RETNPRNT
         ENDCASE
      ENDCASE
      CLEAR

   CASE level1 = 5
      *UTILITIES
      *1- CODES
      *2- RETURN CODES
      *3- REINDEX
      *4- DELETE
      *5- PARAMETERS
      level2 = 1
      DO sub_menu WITH level1

      DO CASE
      CASE level2 = 1
         do CODEMAIL

      CASE level2 = 2
         do RETNCODE

      CASE level2 = 3
         * REINDEX ALL DATA
         DO SCRNHEAD
         @  9, 21 to 11,55
         @ 10, 22 SAY "Reindexing files ... Please wait."
         USE CERTMAIL
         IF FILE("CERT.NTX")
            DELE FILE CERT.NTX
         ENDIF
         INDEX ON ARTICLE_NM TO CERT
         IF FILE("FILE.NTX")
            DELE FILE FILE.NTX
         ENDIF
         INDEX ON FILE_NUM TO FILE
         IF FILE("DEPT.NTX")
            DELE FILE DEPT.NTX
         ENDIF
         INDEX ON DEPT TO DEPT
         IF FILE("NAME.NTX")
            DELE FILE NAME.NTX
         ENDIF
         INDEX ON NAME1 TO NAME
         IF FILE("CODE.NTX")
```

```
      DELE FILE CODE.NTX
   ENDIF
   USE SIDEFILE
   INDEX ON CODE TO CODE
   close data
   CLEAR

CASE level2 = 4
   do DELEMAIL

CASE level2 = 5
   * COMPANY PARAMETER INFORMATION
   DO SCRNHEAD
   RCOMP_NAME  = SPACE(40)
   RCOMP_ADDR  = SPACE(35)
   RCOMP_CITY  = SPACE(20)
   RCOMP_STATE = "  "
   RCOMP_ZIP   = SPACE(10)
   RCOMP_PHON  = SPACE(13)
   RREG_MAIL   = 0
   RR_FEE      = 0
   RCERT_FEE   = 0
   RWEIGHT     = .T.
   RTOWHOM     = 0
   RRESTR      = 0
   RFORMLN     = 0
   IF FILE("COMP.MEM")
      RESTORE FROM COMP ADDITIVE
   ENDIF
   @  6,  5  TO 16, 75
   @  6, 27  SAY " COMPANY PARAMETERS ENTRY "
   @  7, 14  SAY "Company Name"
   @  8, 14  SAY "Company Address"
   @  9, 14  SAY "City/State/Zip"
   @  9, 51  SAY ","
   @ 10, 14  SAY "Company Phone"
   @ 12, 17  SAY "Regular Postage"
   @ 12, 42  SAY "Return Receipt Fee"
   @ 13, 14  SAY "Certified Mail Fee"
   @ 13, 44  SAY "Show to whom Fee"
   @ 14, 18  SAY "Restricted Fee"
   @ 14, 41  SAY "Weight/postage Calc"
   @ 15, 24  SAY 'Form Length (3.5", 4", 5")'
   M_OK = .F.
   DO WHILE .NOT. M_OK
      @  7, 31  GET  RCOMP_NAME
      @  8, 31  GET  RCOMP_ADDR
      @  9, 31  GET  RCOMP_CITY
      @  9, 53  GET  RCOMP_STATE
      @  9, 56  GET  RCOMP_ZIP
      @ 10, 31  GET  RCOMP_PHON PICTURE "(999)999-9999"
      @ 12, 33  GET  RREG_MAIL  PICTURE "99.99"
      @ 12, 61  GET  RR_FEE PICTURE "99.99"
      @ 13, 33  GET  RCERT_FEE PICTURE "99.99"
      @ 13, 61  GET  RTOWHOM PICTURE "99.99"
      @ 14, 33  GET  RRESTR PICTURE "99.99"
      @ 14, 61  GET  RWEIGHT PICTURE "Y"
      @ 15, 51  SAY  RFORMLN PICTURE "9.9"
      READ
      FLEN = .F.
      DO WHILE .NOT. FLEN
         @ 15, 51 GET RFORMLN PICTURE "9.9"
         READ
         IF RFORMLN = 3.5 .OR. RFORMLN = 4 .OR. RFORMLN = 5 .OR.;
            RFORMLN = 8
            FLEN = .T.
            @ 17, 0 CLEAR
         ELSE
```

```
            ? CHR(7)
            @ 17,23 SAY 'FORM LENGTH MUST BE 3.5, 4 OR 5!'
         ENDIF
      ENDDO
      @ 17, 28 SAY "Is everything correct?" GET M_OK PICTURE "Y"
         READ
      ENDDO
      SAVE ALL LIKE R* TO COMP
      close data
   ENDCASE &&level2
ENDCASE &&level1
ENDDO

*****************************************************************************
* SUB MENU - LEVEL 2
*****************************************************************************
PROCEDURE sub_menu
PARAMETER menu_number
SET MESSAGE TO 21 CENTER   && display MESSAGEs on line 21
DO CASE
CASE level1 = 1
   @ 10,16 TO 15,26 DOUBLE
   @ 11,17  PROMPT "CERT MAIL"  MESSAGE "Add Certified Mail"
   @ 12,17  PROMPT "INSURED"    MESSAGE "Add Registered Mail (insured)"
   @ 13,17  PROMPT "UNINSURED"  MESSAGE "Add Registered Mail (uninsured)"
   @ 14,17  PROMPT "COD"        MESSAGE "Add C.O.D. names"
CASE level1 = 2
   @ 10,23 TO 15,33 DOUBLE
   @ 11,24  PROMPT "CERT MAIL"  MESSAGE "Search/Change Certified Mail"
   @ 12,24  PROMPT "INSURED"    MESSAGE "Search/Change Registered Mail (insured
   @ 13,24  PROMPT "UNINSURED"  MESSAGE "Search/Change Registered Mail (uninsur
   @ 14,24  PROMPT "COD"        MESSAGE "Search/Change C.O.D. names"
CASE level1 = 4
   @ 10,44 TO 13,52 DOUBLE
   @ 11,45  PROMPT "FORMS"    MESSAGE "Print Mail Forms"
   @ 12,45  PROMPT "REPORTS"  MESSAGE "Print Reports"
CASE level1 = 5
   @ 10,53 TO 16,64 DOUBLE
   @ 11,54  PROMPT "CODES"      MESSAGE "Maintain code files"
   @ 12,54  PROMPT "RETURNS"    MESSAGE "Maintain return reasons"
   @ 13,54  PROMPT "INDEX"      MESSAGE "Reindex all files"
   @ 14,54  PROMPT "DELETE"     MESSAGE "Mark and Delete Names"
   @ 15,54  PROMPT "PARAMETERS" MESSAGE "Change Company Name and Address"
ENDCASE

MENU TO level2

RETURN
*EOP sub_menu

*****************************************************************************
* SUB MENU - LEVEL 3 for PRINTING
*****************************************************************************
PROCEDURE sub_prnt
PARAMETER menu_number
SET MESSAGE TO 21 CENTER   && display MESSAGEs on line 21
DO CASE
CASE level2 = 1
   @ 12,46 TO 18,56 DOUBLE
   @ 13,47  PROMPT "CERT MAIL"  MESSAGE "Certified Mail Green Cards"
   @ 14,47  PROMPT "FIRM BOOK"  MESSAGE "Form 3877 (Firm Book)"
   @ 15,47  PROMPT "INSURED"    MESSAGE "Registered Mail (insured)"
   @ 16,47  PROMPT "UNINSURED"  MESSAGE "Registered Mail (uninsured)"
   @ 17,47  PROMPT "COD"        MESSAGE "C.O.D. Mail"
CASE level2 = 2
   @ 13,46 TO 18,55 DOUBLE
   @ 14,47  PROMPT "LISTINGS"   MESSAGE "Report all names"
```

```
   @ 15,47  PROMPT "MISSING"    MESSAGE "Unreturned Green Card Report".
   @ 16,47  PROMPT "POSTAGE"    MESSAGE "Postage Fee Detail Report"
   @ 17,47  PROMPT "RETURN"     MESSAGE "Return Disposition Report"
ENDCASE
MENU TO level3
@ 1,0 CLEAR
RETURN
*EOP sub_prnt

*****************************************************************************
* SUB MENU - LEVEL 5 for REPORTS
*****************************************************************************
PROCEDURE sub_menup
PARAMETER menu_number
SET MESSAGE TO 21 CENTER   && display MESSAGEs on line 21
level5 = 1
@ 10,m_lt TO 15,m_lt+11 DOUBLE
@ 11,m_lt+1 PROMPT "CERTIFIED" MESSAGE "Print only certified mail"
@ 12,m_lt+1 PROMPT "INSURED"   MESSAGE "Print only registered insured mail"
@ 13,m_lt+1 PROMPT "UNINSURED" MESSAGE "Print only registered uninsured mail"
@ 14,m_lt+1 PROMPT "C.O.D."    MESSAGE "Print only C.O.D. mail"
MENU TO level5

DO CASE
CASE LEVEL5 = 1
   MFILT = 'MAIL_TYPE = "1"'
   MREPO = "A"
CASE LEVEL5 = 2
   MFILT = 'MAIL_TYPE = "2"'
   MREPO = "B"
CASE LEVEL5 = 3
   MFILT = 'MAIL_TYPE = "3"'
   MREPO = "C"
CASE LEVEL5 = 4
   MFILT = 'MAIL_TYPE = "4"'
   MREPO = "D"
ENDCASE
RETURN
* eop sub_menup

*****************************************************************************
* GETKEY.PRG - GET A KEYSTROKE FOR PAGING PROCESSES
*****************************************************************************
PROCEDURE GETKEY
PUBLIC MKEY
MKEY = " "
SET ESCAPE OFF
SET CONSOLE OFF

DO WHILE .T.
   A = INKEY()
   IF A=3 .OR. A=13 .OR. A=27 .OR. A=1 .OR. A=6
      EXIT
   ENDIF
ENDDO
SET CONSOLE ON
SET ESCAPE ON
DO CASE
   CASE A = 3 .OR. A = 13
      * PAGE ARROW OR RETURN KEY
      MKEY="D"
   CASE A = 27
      * ESCAPE KEY
      MKEY="E"
   CASE A = 1
      * HOME KEY
      MKEY="H"
```

```
   CASE A = 6
      * END KEY
      MKEY="N"
ENDCASE
RETURN
* EOP getkey

*****************************************************************************
* PROCEDURE prntmsg - check if report to screen or printer, printer ready
* scrnline = first of 2 lines for prompting on the screen
* printopt = "S" for screen, "P" for printer, anything else to skip report
* mprnt    = printer ready status - T (ready) or F (not ready)
*****************************************************************************
PROCEDURE prntmsg
PUBLIC scrnline,printopt,mprnt
SET CONSOLE ON
MPRNT = .T.
printopt = " "
@ scrnline, 17 SAY "Press S for SCREEN display, P for PRINTER, or"
SET COLO TO W+*/B
@ scrnline, 23 SAY "S"
@ scrnline, 45 SAY "P"
SET COLO TO W+/B
@ scrnline+1, 22 SAY "any other key to RETURN TO MENU " GET printopt PICT "!"
READ
IF printopt = "P"
   IF .NOT. ISPRINTER()
      DUM = " "
      ? CHR(7)
      @ scrnline, 16 SAY SPACE(47)
      @ scrnline+1, 21 SAY SPACE(36)
      SET COLO TO W+*/B
      @ scrnline, 31 SAY "PRINTER NOT READY!"
      SET COLO TO W+/B
      @ scrnline+1, 23 SAY "Press a key to RETURN TO MENU " GET DUM PICT "!"
      READ
      MPRNT = .F.
   ENDIF
   SET CONSOLE OFF
ENDIF
RETURN
* eop prntmsg

*****************************************************************************
* PROCEDURE SCRNHEAD
*    clears the console screen & displays the
*    company and product information
*    uses lines 2 thru 4 of the screen
*****************************************************************************
PROCEDURE SCRNHEAD
SET CONSOLE ON
CLEAR
SET COLO TO W+/B
@ 02,10 TO 05,70 DOUBLE
@ 03,40-(LEN(MCOMP)/2) SAY MCOMP
@ 04,18 SAY "W A L Z    P O S T A L    S O F T W A R E"
RETURN
*eop scrnhead

*************************************************************
* CERTADDN.PRG - ADD CERTIFIED MAIL NAMES                   *
*************************************************************

MWT        = 0
MMAN_ART   = .F.
MSIDE      = .F.
MTOWHOM    = .F.
```

```
MRESTRICT  = .F.
MSIDE_TYPE = " "

CLEAR
@  1, 10  TO  3, 69    DOUBLE
@  4,  0  TO 19, 79
@  2, 31  SAY "SPECIAL CONDITIONS"
@  5,  9  SAY "ENTER A FIXED MAILING WEIGHT:"
@  5, 45  SAY "OZs. (or 0 if you wish to"
@  6, 19  SAY "enter individual weights for each name.)"
@  8, 10  SAY "DO YOU WISH TO ENTER ARTICLE NUMBERS MANUALLY?"
@ 10, 10  SAY 'DO YOU NEED ITEM #1 ON GREEN CARD "ADDRESSEE'S ADDRESS?"'
@ 12, 10  SAY 'DO YO' NEED ITEM #2 ON GREEN CARD "RESTRICTED DELIVERY?"'
@ 14, 10  SAY "DO YO  ISH TO GET NAMES FROM A SIDE FILE?"

IF RWEIGHT
   @  5, 39  GET  MWT PICTURE "99.99"
ELSE
   @  5, 39  SAY " OFF"
ENDIF
@  8, 68  GET MMAN_ART  PICT "Y"
@ 10, 68  GET MTOWHOM   PICT "Y"
@ 12, 68  GET MRESTRICT PICT "Y"
@ 14, 68  GET MSIDE     PICT "Y"
READ

IF MSIDE
   DO WHILE .NOT. MSIDE_TYPE$"12"
      @ 16, 22  SAY "1) SINGLE CODES OR 2) GROUP CODES" GET  MSIDE_TYPE
      READ
   ENDDO
ENDIF
DO WHILE MSIDE_TYPE = "2"
   MGRP_CODE  = SPACE(8)
   @ 18, 19  SAY "ENTER GROUP CODE:" GET MGRP_CODE
   @ 19, 23  SAY "(OR LEAVE BLANK TO RETURN TO MENU)"
   READ
   IF MGRP_CODE = SPACE(8)
      CLOSE DATA
      RETURN
   ENDIF
   @ 20, 19 SAY "Please wait... Adding data from side file."
   USE SIDETEMP
   ZAP
   APPE FROM SIDEFILE FOR CODE = MGRP_CODE
   MADDED = LASTREC()
   MADDED = STR(MADDED,4)
   DUM = " "
   MNEW_FILE = SPACE(25)
   @ 20, 0 CLEAR
   @ 20, 15 SAY "You will be adding "+MADDED+" names from the side file"
   @ 22,  1 SAY "ENTER A NEW FILE NUMBER FOR THESE NAMES (IF DESIRED)";
      GET MNEW_FILE
   READ
   @ 20,0 CLEAR
   @ 20, 19 SAY "Please wait... Adding data from side file."
   IF MWT = 0
      MWT = 1
   ENDIF
   MPOSTAGE = .25
   DO CASE
      CASE MWT > 10
         MPOSTAGE = 2.25
      CASE MWT > 9
         MPOSTAGE = 2.05
      CASE MWT > 8
         MPOSTAGE = 1.85
      CASE MWT > 7
```

```
            MPOSTAGE = 1.65
         CASE MWT > 6
            MPOSTAGE = 1.45
         CASE MWT > 5
            MPOSTAGE = 1.25
         CASE MWT > 4
            MPOSTAGE = 1.05
         CASE MWT > 3
            MPOSTAGE = .85
         CASE MWT > 2
            MPOSTAGE = .65
         CASE MWT > 1
            MPOSTAGE = .45
      ENDCASE
      REPLACE MAIL_TYPE WITH MMAIL_TYPE ALL
      IF MNEW_FILE <> SPACE(25)
         REPL FILE_NUM WITH MNEW_FILE ALL
      ENDIF
      IF RWEIGHT
         REPLACE WEIGHT WITH MWT ALL
         REPLACE POSTAGE WITH MPOSTAGE ALL
      ENDIF
      REPLACE ENTERED WITH DATE() ALL
      REPLACE FEE WITH RCERT_FEE ALL
      REPLACE R_FEE WITH RR_FEE ALL
      IF MTOWHOM
         REPLACE TO_WHM_FEE WITH RTOWHOM ALL
      ENDIF
      IF MRESTRICT
         REPLACE RESTR_FEE WITH RRESTR ALL
      ENDIF
      USE CERTMAIL
      SET INDE TO FILE, DEPT, CERT, NAME
      APPE FROM SIDETEMP
      @ 20, 0 CLEAR
   ENDDO

   MENTERED  = DATE()
   MOPERATOR = MOPER
   MDEPT     = SPACE(8)
   MFILE_NUM = SPACE(25)
   MADDR1    = SPACE(30)
   MADDR2    = SPACE(30)
   MADDR3    = SPACE(30)
   MCITY     = SPACE(20)
   MST       = "  "
   MZIP      = SPACE(10)
   MPOSTAGE  = RREG_MAIL
   MFEE      = RCERT_FEE
   MR_FEE    = RR_FEE
   MTO_WHM   = 0
   MRESTR    = 0
   MARTICLE  = SPACE(10)
   MVAL      = 0
   MVAL_INS  = 0
   MVAL_COMM = 0

   IF MWT = 0
      MWEIGHT = 1
   ELSE
      MWEIGHT = MWT
   ENDIF

   IF MTOWHOM
      MTO_WHM = RTOWHOM
   ENDIF
```

```
IF MRESTRICT
     MRESTR = RRESTR
ENDIF

MMORE = .T.
SET CONFIRM ON
DO WHILE MMORE
   MREPS = 1
   MCOMMENT  = SPACE(70)
   MARTICLE  = SPACE(10)
   MMAILED   = CTOD("  /  /  ")
   MDONE  = .F.
   MNAME1 = SPACE(30)
   MNAME2 = SPACE(30)
   DO WHILE .NOT. MDONE
      CLEAR
      @  0, 20  TO  2, 60    DOUBLE
      @  1, 40-(LEN(SCRLABEL)/2) SAY SCRLABEL
      @  3,  6  TO 13, 73
      @  4,  8  SAY "Date Entered"
      @  4, 32  SAY "Department"
      @  4, 54  SAY "Operator/Unit"
      @  6, 11  SAY "File Number"
      @  7, 18  SAY "Name"
      @  8, 18  SAY "Name"
      @  9, 15  SAY "Address"
      @ 10, 15  SAY "Address"
      @ 11, 15  SAY "Address"
      @ 12, 18  SAY "City"
      @ 12, 45  SAY "State"
      @ 12, 55  SAY "Zip"

      @ 14,  0  TO 22, 79
      @ 15, 10  SAY "Weight"
      @ 15, 24  SAY "Postage"
      @ 15, 40  SAY "Fees"
      @ 15, 55  SAY "Return Receipt"
      @ 16, 12  SAY "Restricted Delivery"
      @ 16, 40  SAY "To Whom, Date, Address Fee"
      @ 18,  4  SAY "Mailed"
      @ 18, 24  SAY "Article Num."
      @ 18, 52  SAY "Received Back"
      @ 19,  2  SAY "Postal Value"
      @ 19, 29  SAY "Full Value"
      @ 19, 54  SAY "Comm. Ins."
      @ 21,  1  SAY "Comment"

      IF MSIDE_TYPE = "1"
         SELE 2
         USE SIDEFILE INDEX CODE
         MFND = SPACE(8)
         @ 23, 0 CLEAR
         @ 23,  3 SAY "ENTER CODE TO FIND " GET MFND
         @ 23, 52 SAY "ENTER # OF REPETITIONS" GET MREPS PICTURE "999"
         READ
         DO WHILE MFND <> SPACE(8)
            FIND &MFND
            IF .NOT. FOUND()
               ? CHR(7)
               @ 24, 12 SAY "CODE NOT FOUND!! ENTER ANOTHER OR "+;
               "LEAVE BLANK TO PROCEED"
               MFND = SPACE(8)
               @ 23, 3 SAY "ENTER CODE TO FIND " GET MFND
               @ 23, 52 SAY "ENTER # OF REPETITIONS" GET MREPS PICTURE "999"
               READ
            ELSE
               MOPERATOR = OPERATOR
               MDEPT     = DEPT
```

```
            MFILE_NUM = FILE_NUM
            MNAME1    = NAME1
            MNAME2    = NAME2
            MADDR1    = ADDR1
            MADDR2    = ADDR2
            MADDR3    = ADDR3
            MCITY     = CITY
            MST       = ST
            MZIP      = ZIP
            EXIT
         ENDIF
      ENDDO
      SELE 1
   ENDIF

   @  4, 21  GET  MENTERED
   @  4, 43  GET  MDEPT PICTURE "!!!!!!!!"
   @  4, 68  GET  MOPERATOR PICTURE "!!!!!"
   @  6, 23  GET  MFILE_NUM
   @  7, 23  GET  MNAME1
   @  8, 23  GET  MNAME2
   @  9, 23  GET  MADDR1
   @ 10, 23  GET  MADDR2
   @ 11, 23  GET  MADDR3
   @ 12, 23  GET  MCITY
   @ 12, 51  GET  MST
   @ 12, 59  GET  MZIP
   IF RWEIGHT
      @ 15, 17  GET  MWEIGHT PICTURE "999"
   ENDIF
   READ

   IF RWEIGHT
      MPOSTAGE = .25
      DO CASE
         CASE MWEIGHT > 10
            MPOSTAGE = 2.25
         CASE MWEIGHT > 9
            MPOSTAGE = 2.05
         CASE MWEIGHT > 8
            MPOSTAGE = 1.85
         CASE MWEIGHT > 7
            MPOSTAGE = 1.65
         CASE MWEIGHT > 6
            MPOSTAGE = 1.45
         CASE MWEIGHT > 5
            MPOSTAGE = 1.25
         CASE MWEIGHT > 4
            MPOSTAGE = 1.05
         CASE MWEIGHT > 3
            MPOSTAGE = .85
         CASE MWEIGHT > 2
            MPOSTAGE = .65
         CASE MWEIGHT > 1
            MPOSTAGE = .45
      ENDCASE
      @ 15, 32  GET  MPOSTAGE PICTURE "99.99"
   ELSE
      MPOSTAGE = 0
      @ 15, 17  SAY " OFF"
      @ 15, 32  SAY " OFF"
   ENDIF
   IF MMAIL_TYPE = "4" .OR. MMAIL_TYPE = "1"
      @ 15, 45  GET  MFEE PICTURE "99.99"
      @ 15, 70  GET  MR_FEE PICTURE "99.99"
   ENDIF
   IF MRESTRICT
      @ 16, 32  GET  MRESTR PICTURE "9.99"
```

```
ELSE
   @ 16, 32  SAY " OFF"
ENDIF
IF MTOWHOM
   @ 16, 67  GET  MTO_WHM PICTURE "9.99"
ELSE
   @ 16, 67  SAY " OFF"
ENDIF
@ 18, 11  SAY  "  /  /  "
IF MMAN_ART
   @ 18, 37  GET  MARTICLE PICTURE "!!!!!!!!!!"
   @ 18, 66  GET  MMAILED
ELSE
   @ 18, 66  SAY  "  /  /  "
ENDIF
IF MMAIL_TYPE = "1" .OR. MMAIL_TYPE = "4"
   @ 19, 15  SAY  " OFF"
   @ 19, 40  SAY  " OFF"
   @ 19, 66  SAY  " OFF"
ELSE
   @ 19, 15  GET  MVAL PICTURE "99999999.99"
   READ
   DO INSRFEES
   GETFEE = .T.
   @ 15, 45  GET  MFEE PICTURE "9999.99"
   @ 15, 70  GET  GETFEE PICTURE "Y"
   READ
   IF GETFEE
      @ 15, 70  GET  MR_FEE PICTURE "99.99"
   ELSE
      MR_FEE = 0
      @ 15, 70 SAY " OFF"
   ENDIF
   MVAL_INS = MVAL
   @ 19, 40  GET  MVAL_INS  PICTURE "99999999.99"
   READ
   MVAL_COMM = MVAL_INS - MVAL
   @ 19, 65  GET  MVAL_COMM PICTURE "99999999.99"
   READ
ENDIF
@ 21,  9  GET  MCOMMENT
READ

@ 23,0 CLEAR
SET COLO TO I
@ 23, 2  SAY "<PgDn> ADD ANOTHER,  <Home> START OVER,"+;
             " <End> EXIT/SAVE, <Esc> EXIT/NO SAVE"
SET COLO TO W+/B
DO GETKEY
DO CASE
    CASE MKEY = "H"
       * <HOME>
       LOOP
    CASE MKEY = "E"
       * <ESC>
       MNAME1 = SPACE(30)
       MDONE = .T.
       MMORE = .F.
    CASE MKEY = "D"
       * <PG DN>
       MDONE = .T.
    CASE MKEY = "N"
       * <END>
       MDONE = .T.
       MMORE = .F.
  ENDCASE
ENDDO MDONE
```

```
   IF MNAME1 <> SPACE(30)
      USE CERTMAIL
      SET INDE TO FILE, DEPT, CERT, NAME
      @ 23, 0 CLEAR
      @ 23, 29 SAY "ADDING FILE     OF "+STR(MREPS,3)
      FOR I = 1 TO MREPS
         @ 23,41 SAY I PICTURE "999"
         APPE BLANK
         REPLACE ENTERED WITH MENTERED,OPERATOR WITH MOPERATOR,DEPT WITH;
            MDEPT,FILE_NUM WITH MFILE_NUM,NAME1 WITH MNAME1,NAME2 WITH MNAME2
         REPLACE ADDR1 WITH MADDR1,ADDR2 WITH MADDR2,ADDR3 WITH MADDR3,;
            CITY WITH MCITY ST WITH MST,ZIP WITH MZIP,WEIGHT WITH MWEIGHT
         REPLACE POSTAGE WITH MPOSTAGE,FEE WITH MFEE,R_FEE WITH MR_FEE,;
            TO_WHM_FEE WITH MTO_WHM,RESTR_FEE WITH MRESTR
         REPLACE MAIL_TYPE WITH MMAIL_TYPE,COUNT WITH 1,ARTICLE_NM WITH;
            MARTICLE,VALUE WITH MVAL,VALUE_INS WITH MVAL_INS
         REPLACE VALUE_COMM WITH MVAL_COMM,MAILED WITH MMAILED
      NEXT I
      MOPER = MOPERATOR
   ENDIF
ENDDO MMORE
CLOSE DATA
SET CONFIRM OFF

*************************************************************
* CERTFIND.PRG - CHANGE MAIL NAMES                          *
*************************************************************
level3 = 1
USE CERTMAIL
DO WHILE (level3 # 0)
   SET MESSAGE TO 20 CENTER   && display MESSAGEs on line 20
   DO scrnhead
   @ 22,10 to 24,69
   @ 23,12 SAY "Use <- -> or first letter of command, press ESC to EXIT."
   @  7, 40-(LEN(MLABL)/2) SAY MLABL
   @  8, 20 TO 10,60

*NAME     FILE#     ARTICLE    DEPT
*24       32        41         52

   @  9, 24  PROMPT "NAME"    MESSAGE "Search by Name"
   @  9, 32  PROMPT "FILE#"   MESSAGE "Search by File Number"
   @  9, 41  PROMPT "ARTICLE" MESSAGE "Search by Article Number"
   @  9, 52  PROMPT "DEPT"    MESSAGE "Search by Department"

   MENU TO level3

   DO CASE
   CASE level3=1
      DO scrnhead
      @ 6,10 TO 13,70
      MNAME = SPACE(30)
      @   7,15 SAY "ENTER NAME TO FIND " GET MNAME
      @   8,17 SAY "(TYPE FIRST NAME LINE AS ENTERED FOR MAILING)"
      READ
      SET INDE TO NAME,FILE,DEPT,CERT
      SET FILTER TO MAIL_TYPE = MMAIL_TYPE
      IF MNAME = SPACE(30)
         LOOP
      ENDIF
      MNAME = TRIM(MNAME)
      FIND &MNAME
      IF FOUND()
         MCONT = .T.
         DO WHILE NAME1 = MNAME .AND. MCONT .AND. .NOT. EOF()
            DO FINDNAME
            @ 23,0 CLEAR
            SET COLO TO I
```

```
        @ 23, 10 SAY "<PgDn> NEXT NAME, <Home> START OVER,"+;
                     " <End> or <Esc> EXIT/SAVE"
        SET COLO TO W+/B
        DO GETKEY
        DO CASE
        CASE MKEY = "H"
           * HOME
           LOOP
        CASE MKEY = "E"
           * ESCAPE
           MCONT = .F.
        CASE MKEY = "D"
           * PG DN OR ENTER
           SKIP
        CASE MKEY = "N"
           * END
           MCONT = .F.
        ENDCASE
      ENDDO
   ELSE
      DUM = " "
      @ 11,15 SAY "CAN'T FIND THAT FILE,  OR IT IS NOT THE RIGHT TYPE"
      @ 12,27 SAY "PRESS A KEY TO CONTINUE: " GET DUM
      READ
   ENDIF


CASE level3=2
   DO scrnhead
   @ 6,10 TO 13,70
   MFILE = SPACE(25)
   @  7,13 SAY "ENTER FILE NUMBER TO FIND " GET MFILE
   READ
   IF MFILE = SPACE(25)
      LOOP
   ENDIF
   SET INDE TO FILE,DEPT,CERT,NAME
   SET FILTER TO MAIL_TYPE = MMAIL_TYPE
   MFILE = TRIM(MFILE)
   FIND &MFILE
   IF FOUND()
      MCONT = .T.
      DO WHILE FILE_NUM = MFILE .AND. MCONT .AND. .NOT. EOF()
         DO FINDNAME
         @ 23,0 CLEAR
         SET COLO TO I
         @ 23, 10 SAY "<PgDn> NEXT NAME, <Home> START OVER,"+;
                      " <End> or <Esc> EXIT/SAVE"
         SET COLO TO W+/B
         DO GETKEY
         DO CASE
         CASE MKEY = "H"
            LOOP
         CASE MKEY = "E"
            MCONT = .F.
         CASE MKEY = "D"
            SKIP
         CASE MKEY = "N"
            MCONT = .F.
         ENDCASE
      ENDDO
   ELSE
      DUM = " "
      @ 11,15 SAY "CAN'T FIND THAT FILE,  OR IT IS NOT THE RIGHT TYPE"
      @ 12,27 SAY "PRESS A KEY TO CONTINUE: " GET DUM
      READ
   ENDIF
```

```
CASE level3=3
   DO scrnhead
   @ 6,10 TO 13,70
   MARTICLE = SPACE(10)
   @  7,20 SAY "ENTER ARTICLE NUMBER TO FIND " GET MARTICLE
   READ
   IF MARTICLE = SPACE(10)
      LOOP
   ENDIF
   SET INDE TO CERT,FILE,DEPT,NAME
   SET FILTER TO MAIL_TYPE = MMAIL_TYPE
   MARTICLE = TRIM(MARTICLE)
   FIND &MARTICLE
   IF FOUND()
      MCONT = .T.
      DO WHILE ARTICLE_NM = MARTICLE .AND. MCONT .AND. .NOT. EOF()
         DO FINDNAME
         @ 23,0 CLEAR
         SET COLO TO I
         @ 23, 10 SAY "<PgDn> NEXT NAME, <Home> START OVER,"+;
                      " <End> or <Esc> EXIT/SAVE"
         SET COLO TO W+/B
         DO GETKEY
         DO CASE
         CASE MKEY = "H"
            LOOP
         CASE MKEY = "E"
            MCONT = .F.
         CASE MKEY = "D"
            SKIP
         CASE MKEY = "N"
            MCONT = .F.
         ENDCASE
      ENDDO
   ELSE
      DUM = " "
      @ 11,15 SAY "CAN'T FIND THAT FILE,  OR IT IS NOT THE RIGHT TYPE"
      @ 12,27 SAY "PRESS A KEY TO CONTINUE: " GET DUM
      READ
   ENDIF

CASE level3=4
   DO scrnhead
   @ 6,10 TO 13,70
   MDEPT = "        "
   @  7,20 SAY "ENTER DEPARTMENT NUMBER TO FIND " GET MDEPT PICT "!!!!!!!!"
   READ
   IF MDEPT = SPACE(8)
      LOOP
   ENDIF
   SET INDE TO DEPT,FILE,CERT,NAME
   SET FILTER TO MAIL_TYPE = MMAIL_TYPE
   MDEPT = TRIM(MDEPT)
   FIND &MDEPT
   IF FOUND()
      MCONT = .T.
      DO WHILE DEPT = MDEPT .AND. MCONT .AND. .NOT. EOF()
         DO FINDNAME
         @ 23,0 CLEAR
         SET COLO TO I
         @ 23, 10 SAY "<PgDn> NEXT NAME, <Home> START OVER,"+;
                      " <End> or <Esc> EXIT/SAVE"
         SET COLO TO W+/B
         DO GETKEY
         DO CASE
         CASE MKEY = "H"
            LOOP
         CASE MKEY = "E"
```

```
            MCONT = .F.
         CASE MKEY = "D"
            SKIP
         CASE MKEY = "N"
            MCONT = .F.
         ENDCASE
      ENDDO
   ELSE
      DUM = " "
      @ 11,15 SAY "CAN'T FIND THAT FILE,  OR IT IS NOT THE RIGHT TYPE"
      @ 12,27 SAY "PRESS A KEY TO CONTINUE: " GET DUM
      READ
   ENDIF

   ENDCASE
ENDDO  &&LEVEL3 = 0
CLOSE DATA
RETURN

*************************************************************
* UPDTMAIL.PRG - UPDATE RETURN RECEIPT DATE                 *
*************************************************************

DONE = .F.
DO WHILE .NOT. DONE
DO scrnhead
@ 6,10 TO 13,70
MARTICLE = SPACE(10)
@  9,20 SAY "ENTER ARTICLE NUMBER TO FIND " GET MARTICLE
READ
IF MARTICLE = SPACE(10)
   DONE = .T.
   RETURN
ENDIF
USE CERTMAIL
* CHECK FOR MULTI USER
SET INDE TO CERT, FILE, DEPT, NAME
MARTICLE = TRIM(MARTICLE)
FIND &MARTICLE
IF FOUND()
   CLEAR
   SCRLABEL = "UPDATE RETURN RECEIPT DATE"
   @  0, 20  TO  2, 60    DOUBLE
   @  1, 40-(LEN(SCRLABEL)/2) SAY SCRLABEL
   @  3,  6  TO 13, 73
   @  4,  8  SAY "Date Entered"
   @  4, 32  SAY "Operator/Unit"
   @  4, 53  SAY "Department"
   @  6, 11  SAY "File Number"
   @  7, 18  SAY "Name"
   @  8, 18  SAY "Name"
   @  9, 15  SAY "Address"
   @ 10, 15  SAY "Address"
   @ 11, 15  SAY "Address"
   @ 12, 18  SAY "City"
   @ 12, 45  SAY "State"
   @ 12, 55  SAY "Zip"

   @ 14,  0  TO 22, 79
   @ 15, 10  SAY "Weight"
   @ 15, 24  SAY "Postage"
   @ 15, 40  SAY "Fees"
   @ 15, 52  SAY "Return Receipt"
   @ 16, 12  SAY "Restricted Delivery"
   @ 16, 40  SAY "To Whom, Date, Address Fee"
   @ 18,  4  SAY "Mailed"
   @ 18, 24  SAY "Article Num."
```

```
   @ 18, 52  SAY "Recieved Back"
   @ 19,  5  SAY "Value"
   @ 19, 23  SAY "Insured Value"
   @ 19, 49  SAY "Commercial Value"
   @ 21,  1  SAY "Comment"
   @  4, 21  SAY  ENTERED
   @  4, 46  SAY  OPERATOR
   @  4, 64  SAY  DEPT
   @  6, 23  SAY  FILE_NUM
   @  7, 23  SAY  NAME1
   @  8, 23  SAY  NAME2
   @  9, 23  SAY  ADDR1
   @ 10, 23  SAY  ADDR2
   @ 11, 23  SAY  ADDR3
   @ 18, 66  SAY  RECD
   @ 12, 23  SAY  CITY
   @ 12, 51  SAY  ST
   @ 12, 59  SAY  ZIP
   @ 15, 17  SAY  WEIGHT      PICTURE "999"
   @ 15, 32  SAY  POSTAGE     PICTURE "99.99"
   @ 15, 45  SAY  FEE         PICTURE "99.99"
   @ 15, 67  SAY  R_FEE       PICTURE "99.99"
   @ 16, 32  SAY  RESTR_FEE   PICTURE "9.99"
   @ 16, 67  SAY  TO_WHM_FEE  PICTURE "9.99"
   @ 18, 37  SAY  ARTICLE_NM
   @ 18, 66  SAY  MAILED
   @ 19, 11  SAY  VALUE       PICTURE "9999999.99"
   @ 19, 37  SAY  VALUE_INS   PICTURE "9999999.99"
   @ 19, 66  SAY  VALUE_COMM  PICTURE "9999999.99"
   @ 21,  9  SAY  COMMENT

   MCORRECT = .N.
   @ 23, 26  SAY "IS THIS THE CORRECT FILE? " GET MCORRECT PICTURE "Y"
   READ
   IF MCORRECT
      REPLACE RECD WITH DATE()
      R_CODE = "   "
      R_REAS = SPACE(30)
      DO RETNMAIL
      @ 23,0 CLEAR
      SET COLO TO W+*/B
      @ 23, 16 SAY "RETURN CODE:"+R_CODE+" ["+R_REAS+"]"
      SET COLO TO W+/B
      @ 18, 66  GET RECD
      READ
      REPLACE RETN_CODE WITH R_REAS
   ENDIF
ELSE
   DUM = " "
   @ 10,16 SAY "CAN'T FIND THAT FILE, PRESS A KEY TO CONTINUE: " GET DUM
   READ
ENDIF
ENDDO DONE

*************************************************************************
* PROCEDURE RETNMAIL - SELECT RETURN CODE DESCRIPTIONS
*************************************************************************
PROCEDURE RETNMAIL
SELECT 2
USE RETNCODE
INDEX ON CODE TO RETNCODE
SET DELETED ON
cur_el = 1
rel_row = 0
ret_row = 0
REC_CNT = 0
MPACK = .F.
```

```
SAVE SCREEN TO UPDTSCRN

COUNT FOR .NOT. DELETED() TO REC_CNT
DECLARE M_LINE[REC_CNT], M_REC[REC_CNT]

@ 22,10 CLEAR TO 24,73
@ 22,10 to 24,73
@ 23,13 SAY "Use Up/Dn arrow or first letter of code to point to code
@  8,20 CLEAR TO 21,60
@  9,22  SAY "Code         Description"
@  8,20 TO 21,60

GO TOP
I = 1
DO WHILE .NOT. EOF()
   IF .NOT. DELETED()
      M_LINE[I] = CODE+" "+DESCRIP
      M_REC[I] = RECNO()
      I = I + 1
   ENDIF
   SKIP
ENDDO
@ 20, 21 SAY "Press <Enter> to use the selected code"
top=11
lt=24
bot=18
rt=57
edit_type = 0
*************************************************************************
N = ACHOICE(top, lt, bot, rt, M_LINE, .T.)
*************************************************************************
GOTO M_REC[N]
R_CODE = CODE
R_REAS = DESCRIP
SELE 1

RESTORE SCREEN FROM UPDTSCRN
RETURN

*************************************************************
* CERTPRNT.PRG - PRINT CERTIFIED MAIL ON WALZ MAILERS       *
*************************************************************

DO scrnhead
DUM = " "
SAVENM = SPACE(10)
MDEPT  = SPACE(8)
MDATE  = DATE()
MCERT  = SPACE(10)
MLASTNUM = SPACE(10)
MLAST  = SPACE(10)
MRESTRT= .F.
PRTDONE= .F.
PRINTED = .F.
MPRINT = .T.
line = PROW()

DO WHILE .NOT. PRTDONE
   @  6, 10 TO 16, 70
   @  6, 40-(LEN(SCRLABEL)/2) SAY SCRLABEL
   @  7, 13 SAY "ARE YOU RESTARTING A PREVIOUS MAILING (Y/N)  ";
   GET MRESTRT PICT "Y"
   READ
   @  8, 13 SAY "ENTER DEPARTMENT CODE (LEAVE BLANK FOR ALL): " GET MDEPT
   @  9, 13 SAY "ENTER POSTED MAIL DATE:                      " GET MDATE
   @ 10, 13 SAY "ENTER STARTING ARTICLE NUMBER:               " GET MCERT
   @ 11, 13 SAY "ENTER ENDING ARTICLE NUMBER FOR THIS CASE:   " GET MLASTNUM
```

```
   IF MRESTRT
      @ 12, 13 SAY "ENTER LAST CORRECTLY PRINTED ARTICLE NUMBER: " GET MLAST
   ENDIF
   @ 13, 13 SAY "PUT FORMS IN PRINTER, PRESS P TO PRINT OR ANY OTHER KEY"
   SET COLO TO W+*/B
   @ 13, 41 SAY "P"
   SET COLO TO W+/B
   @ 14, 22 SAY "TO RETURN TO FORMS AND REPORTS MENU" GET DUM PICT "!"
   READ
   IF DUM <> "P"
      RETURN
   ENDIF

   * 'RFORMLNB' SET TO '3.5' OR '4' OR '5' IN UTILITIES (FORM LENGTH)
   MLINES = RFORMLN * 6

   MSAMP = .Y.
   @ 15, 11 CLEAR TO 15,68
   @ 15, 24 SAY "DO YOU WANT TO PRINT A SAMPLE?" GET MSAMP PICT "Y"
   READ
   MSCERT = MCERT
   MCERT = TRIM(MCERT)
   USE CERTMAIL

   IF MDEPT = SPACE(8)
      MNDX = "C"
   ELSE
   MNDX = "D"
   SET INDE TO DEPT
   FIND &MDEPT
   IF .NOT. FOUND()
      DUM = " "
      @ 17, 11 CLEAR TO 17,68
      @ 17, 15 SAY "DEPT NUMBER NOT FOUND, PRESS A KEY TO TRY AGAIN ";
         GET DUM
      READ
      CLOSE DATA
      LOOP
   ENDIF
ENDIF

*****************************************************
* RESTART
*****************************************************
IF MRESTRT
DO WHILE MPRINT
   SET INDE TO CERT
   FIND &MLAST
   IF .NOT. FOUND()
      DUM = " "
      @ 17, 11 CLEAR TO 17,68
      @ 17, 15 SAY "CERT NUMBER NOT FOUND, PRESS A KEY TO TRY AGAIN ";
         GET DUM
      READ
      CLOSE DATA
      LOOP
   ENDIF
   SKIP
   MREC = RECNO()
   MCOUNT = 1
   DO WHILE MAILED = MDATE .AND. .NOT. EOF()
      MCOUNT = MCOUNT + 1
      SKIP
   ENDDO
   DECLARE RECN[MCOUNT]
   GOTO MREC
   FOR I = 1 TO MCOUNT - 1
      RECN[I] = RECNO()
```

```
   SKIP
NEXT I
FOR I = 1 TO MCOUNT -1
   GOTO RECN[I]
   SET DEVI TO SCRE
   IF TRIM(MCERT) = TRIM(MLASTNUM)
      MSAMP = .Y.
      MQUIT = .F.
      @ 19,  0 CLEAR
      @ 19,22 SAY "PRINT INTERRUPTED TO ADD MORE FORMS."
      @ 22, 29 SAY "DO YOU WANT TO EXIT?" GET MQUIT PICT "Y"
      READ
      IF MQUIT
         MPRINT = .F.
            LOOP
         ENDIF
         @ 20,23 SAY "ENTER NEW STARTING ARTICLE NUMBER" GET MCERT
         @ 21,14 SAY "ENTER ENDING ARTICLE NUMBER FOR THIS CASE ";
            GET MLASTNUM
         @ 22, 24 SAY "DO YOU WANT TO PRINT A SAMPLE?" GET MSAMP PICT "Y"
         READ
      ENDIF
      @ 19, 0 CLEAR
      SET COLO TO W+*/B
      @ 19, 26 SAY "PRINTING.. PRESS ESC TO STOP"
      SET COLO TO W+/B
      SET CONSO OFF
      MA = INKEY()
      SET CONSO ON
      IF MA = 27
         MPRINT = .F.
         EXIT
      ENDIF

      * CHECK PRINTER
      MREADY = .F.
      DO WHILE .NOT. MREADY
         DO CKPRINT
      ENDDO

      IF DUM = "X"
         MPRINT = .F.
         EXIT
      ENDIF

      PRINTED = .T.
      IF MMAIL_TYPE = MAIL_TYPE
         IF MDEPT = SPACE(8)
            DO PRNTLINE
         ELSE
            IF DEPT = MDEPT
               DO PRNTLINE
            ENDIF
         ENDIF
      ENDIF

      IF MSAMP
         SET DEVI TO SCRE
         @ 15,11 CLEAR TO 15,68
         @ 15,26 SAY "NEED ANOTHER SAMPLE (Y/N)?" GET MSAMP PICT "Y"
         READ
         @ 15,11 CLEAR TO 15,68
         IF MSAMP
            I = I - 1
         ENDIF
      ENDIF

      @ 15,11 CLEAR TO 15,69
      SET DEVI TO SCRE
```

```
      @ 15,28 SAY "PROCESSING: "+MCERT
      SET DEVI TO PRINT

      REPLACE MAILED WITH MDATE
      REPLACE ARTICLE_NM WITH MCERT
      SAVENM = MCERT
      DO ROTATENM
   NEXT I && MCOUNT TIMES
   EXIT
ENDDO && MPRINT
ENDIF
*****************************************************
* END OF RESTART
*
* MNDX = D - BY DEPT
* MNDX = C - BY ARTICLE_NM
*****************************************************************

IF MNDX = "D"
   SET INDE TO DEPT, CERT
   FIND &MDEPT
ELSE
   SET INDE TO CERT
   GO TOP
ENDIF

DO WHILE MPRINT .AND. .NOT. EOF()
   SET DEVI TO SCRE
   IF MNDX = "D"
      * CHECK THE DEPARTMENT - IT IS INDEXED. IF IT DOESN'T MATCH
      * WE WILL EXIT
      READ
      IF DEPT <> MDEPT
         EXIT
      ENDIF
   ENDIF

   * NEW BOX OF FORMS - WE HAVE REACHED THE END OF A BOX
   IF TRIM(MCERT) = TRIM(MLASTNUM)
      MSAMP = .T.
      MQUIT = .F.
      @ 19,  0 CLEAR
      @ 19,22 SAY "PRINT INTERRUPTED TO ADD MORE FORMS."
      @ 22, 29 SAY "DO YOU WANT TO EXIT?" GET MQUIT PICT "Y"
      READ
      IF MQUIT
         MPRINT = .F.
         LOOP
      ENDIF
      @ 20,23 SAY "ENTER NEW STARTING ARTICLE NUMBER" GET MCERT
      @ 21,14 SAY "ENTER ENDING ARTICLE NUMBER FOR THIS CASE ";
         GET MLASTNUM
      @ 22, 24 SAY "DO YOU WANT TO PRINT A SAMPLE?" GET MSAMP PICT "Y"
      READ
   ENDIF
   IF MAIL_TYPE <> MMAIL_TYPE
      SKIP
      LOOP
   ENDIF
   IF ARTICLE_NM <> SPACE(10)
      IF MNDX = "C"
         EXIT
      ENDIF
      SKIP
      LOOP
   ENDIF
   @ 19, 0 CLEAR
```

```
SET COLO TO W+*/B
@ 19, 26 SAY "PRINTING.. PRESS ESC TO STOP"
SET COLO TO W+/B
SET CONSO OFF

* GET A KEY - SEE IF THE OPERATOR ESCAPED
MA = INKEY()
SET CONSO ON
IF MA = 27
   MPRINT = .F.
   LOOP
ENDIF

* CHECK PRINTER
MREADY = .F.
DO WHILE .NOT. MREADY
   DO CKPRINT
ENDDO

* OPERATOR EXITED FROM THE PRINT CHECK
IF DUM = "X"
   MPRINT = .F.
   LOOP
ENDIF

* PRINT A GREEN CARD
PRINTED = .T.
DO PRNTLINE

IF MSAMP
   SET DEVI TO SCRE
   @ 15,11 CLEAR TO 15,68
   @ 15,26 SAY "NEED ANOTHER SAMPLE (Y/N)?" GET MSAMP PICT "Y"
   READ
   @ 15,11 CLEAR TO 15,68
   IF MSAMP
      * INCREMENT THE CERT NUMBER AND GO BACK TO PRINT THIS AGAIN
      DO ROTATENM
      LOOP
   ENDIF
ENDIF

REPLACE MAILED WITH MDATE
     REPLACE ARTICLE_NM WITH MCERT
     SAVENM = MCERT
     * INCREMENT THE CERT NUMBER
     DO ROTATENM
     IF MNDX = "C"
        * LOOKING FOR BLANK CERT NUMBERS
        GO TOP
     ELSE
        * LOOPING THROUGH A SPECIFIC DEPARTMENT
        SKIP
     ENDIF
  ENDDO && ARTICL_NM NOT BLANK OR NO MORE FOR THIS DEPARTMENT
  PRTDONE = .T.
ENDDO && PRTDONE

MECERT = SAVENM + SPACE(10)
MECERT = LEFT(MECERT,10)
SET DEVI TO SCRE
@ 19, 0 CLEAR
@ 15,11 CLEAR TO 15,68
@ 17,11 CLEAR TO 17,68
IF .NOT. PRINTED
   DUM = " "
   @ 15, 14 SAY "NO NAMES FOUND OR PRINT INTERRUPTED. PRESS ANY KEY ";
      GET DUM
```

```
   READ
   CLOSE DATA
   RETURN
ENDIF
DUM = .Y.
@ 15,15 SAY "PRINT COMPLETE. DO YOU WANT TO PRINT FORM 3877?";
  GET DUM PICTURE "Y"
READ
IF DUM
   DO PRNT3877
ENDIF
CLOSE DATA
RETURN

****************************************
* CHECK TO SEE IF THE PRINTER IS ON LINE
****************************************
PROCEDURE CKPRINT
IF .NOT. ISPRINTER()
   ? CHR(7)
   SET COLO TO W+*/B
   DUM = " "
   @ 17,17 SAY CHR(7)
   @ 17,16 SAY "PRINTER NOT READY!! CHECK PRINTER, PRESS ANY KEY"
   @ 18,26 SAY "TO TRY AGAIN OR X TO EXIT " GET DUM PICT "!"
   READ
   @ 17,16 CLEAR
   SET COLO TO W+/B
ELSE
   @ 17, 16 CLEAR TO 18,70
   MREADY = .T.
   SET DEVI TO PRINT
ENDIF
RETURN

****************************************
* PRINT THE CERT MAIL LINES ON THE FORM
****************************************
PROCEDURE PRNTLINE
ln1 = name1
ln2 = trim(name2)
ln3 = trim(addr1)
ln4 = trim(addr2)
ln5 = trim(addr3)
ln6 = trim(city)+", "+st+" "+zip
tst = ln2+ln3+ln4+ln5+ln6
DO WHILE len(ln2) = 0 .and. len(tst) > 0
   ln2 = ln3
   ln3 = ln4
   ln4 = ln5
   ln5 = ln6
   ln6 = ""
ENDDO
tst = ln3+ln4+ln5+ln6
do while len(ln3) = 0 .and. len(tst) > 0
   ln3 = ln4
   ln4 = ln5
   ln5 = ln6
   ln6 = ""
enddo
tst = ln4+ln5+ln6
do while len(ln4) = 0 .and. len(tst) > 0
   ln4 = ln5
   ln5 = ln6
   ln6 = ""
enddo
tst = ln5+ln6
```

```
do while len(ln5) = 0 .and. len(tst) > 0
  ln5 = ln6
  ln6 = ""
enddo

@ line,10 say FILE_NUM
line = line + 1
@ line,10 say ln1
line = line + 1
@ line,10 say ln2
line = line + 1
@ line,10 say ln3
line = line + 1
@ line,10 say ln4
line = line + 1
@ line,10 say ln5
line = line + 1
@ line,10 say ln6
line = line + 9
@ line, 30 SAY "DM: "
@ line, 34 SAY DATE()
@ line, 43 SAY " / "+TRIM(DEPT)+" / "+TRIM(OPERATOR)

line = line + MLINES - 15
@ line,0 say "    "
RETURN

*************************************************************
* ROTATENM.PRG - ROTATE THE CERT ARTICLE NUMBER             *
*************************************************************
PROCEDURE ROTATENM
NUMBER= 0
STRTLEN = LEN(MCERT)
INPOS = LEN(MCERT)
POWER = 0
MNUM  = 9
MRIGHT = RIGHT(MCERT,1)

IF LTRIM(STR(VAL(MRIGHT))) <> MRIGHT
   RETURN
ENDIF

DO WHILE INPOS > 0
   PIECE = SUBSTR(MCERT,INPOS,1)
   MNUM = VAL(PIECE)
   IF LTRIM(STR(MNUM)) <> PIECE
      EXIT
   ENDIF
   NUMBER = NUMBER + (MNUM * (10 ^ POWER))
   INPOS = INPOS - 1
   POWER = POWER + 1
ENDDO

NUMBER = NUMBER + 1
MCERT = LEFT(MCERT,INPOS)+LTRIM(STR(NUMBER,10,0))

DO WHILE  LEN(MCERT) < STRTLEN
   MCERT = LEFT(MCERT,INPOS)+"0"+LTRIM(STR(NUMBER,10,0))
   INPOS = INPOS + 1
ENDDO

*************************************************************
* PRNT3877.PRG - PRINT THE 3877 (LOG BOOK) REPORT           *
*************************************************************
DO scrnhead
SET MESSAGE TO 20 CENTER   && display MESSAGEs on line 20
@ 22,10 to 24,69
@ 23,12 SAY "Use <- -> or first letter of command, press ESC to EXIT."
```

```
MLABL = "PRINT 3877 FIRM BOOK"
@  7, 40-(LEN(MLABL)/2) SAY MLABL
@  8, 12 TO 10,68

*CERTIFIED    INSURED/REG    UNINSURED/REG    C.O.D.
*14           27             42               59

@  9, 14  PROMPT "CERTIFIED"     MESSAGE "Print Certified firm book"
@  9, 27  PROMPT "INSURED/REG"   MESSAGE "Print Registered Insured firm book"
@  9, 42  PROMPT "UNINSURED/REG" MESSAGE "Print Registered Uninsured firm book"
@  9, 59  PROMPT "C.O.D."        MESSAGE "Print C.O.D. firm book"

MENU TO firm_type

MMAIL_TYPE = str(firm_type,1)
USE CERTMAIL
DO scrnhead
DUM = " "
REPRNT = .F.
PSBATCH = 0
PSDATE = DATE()
MDEPT = SPACE(8)
@  6, 10 TO 16, 70
@  6, 23 SAY " P R I N T    3 8 7 7    F O R M "
@  8, 21 SAY "ARE YOU REPRINTING A PREVIOUS 3877? " GET REPRNT PICTURE "Y"
READ
IF REPRNT
   @  9, 21 SAY "ENTER BATCH NUMBER TO PRINT:      " GET PSBATCH PICT "99"
   @ 10, 21 SAY "ENTER POSTED MAIL DATE:           " GET PSDATE
   READ
ELSE
   @  9, 21 SAY "THIS WILL BE YOUR POSTED DATE:    " + DTOC(PSDATE)
   @ 10, 21 SAY "ENTER DEPARTMENT TO PRINT:        " GET MDEPT
   @ 11, 21 SAY "Or leave blank to print all departments"
   READ
ENDIF
@ 13, 12 SAY "PLACE 8.5 X 11 PAPER IN PRINTER, PRESS P TO PRINT OR ANY"
@ 14, 16 SAY "OTHER KEY TO RETURN TO FORMS AND REPORTS MENU" GET DUM PICT "!"
SET COLO TO W+*/B
@ 13, 51 SAY "P"
SET COLO TO W+/B
READ

IF DUM <> "P"
   RETURN
ENDIF

SET COLO TO W+*/B
@ 17, 23 SAY "Please wait... Printing 3877 form."
SET COLO TO W+/B
SET DEVI TO PRINT
LN = 99
PG = 1
CERTCNT = 0
POSTTOT = 0
FEESTOT = 0
RFEETOT = 0
IF .NOT. REPRNT
   RESTORE FROM PS3877 ADDITIVE
   IF DATE() <> PSDATE
      PSDATE = DATE()
      PSBATCH = 0
   ENDIF
   PSBATCH = PSBATCH + 1
ENDIF
MPRNTD = .F.
DO WHILE .NOT. EOF()
```

```
IF REPRNT
   IF FIRM_BATCH <> STR(PSBATCH,2) .OR. FIRM_PRTD <> PSDATE
      SKIP
      LOOP
   ENDIF
ELSE
   IF FIRM_BATCH <> " " .OR. DTOC(FIRM_PRTD) <> "  /  /  " .OR.;
      ARTICLE_NM = SPACE(10)
      SKIP
      LOOP
   ENDIF
   IF MAIL_TYPE <> MMAIL_TYPE
      SKIP
      LOOP
   ENDIF
   IF MDEPT <> SPACE(8) .AND. DEPT <> MDEPT
      SKIP
      LOOP
   ENDIF
   REPLACE FIRM_BATCH WITH STR(PSBATCH,2), FIRM_PRTD WITH PSDATE
ENDIF
IF LN > 50
   @  0,  1  SAY RCOMP_NAME
   @  0, 70  SAY "PAGE:"+LTRIM(STR(PG))
   @  1,  1  SAY RCOMP_ADDR
   DO CASE
   CASE MMAIL_TYPE = "1"
      MTYPEMSG = "CERTIFIED MAIL"
   CASE MMAIL_TYPE = "2"
      MTYPEMSG = "REGIST. MAIL W/INSURANCE"
   CASE MMAIL_TYPE = "3"
      MTYPEMSG = "REGIST. MAIL/NO INSURANCE"
   CASE MMAIL_TYPE = "4"
      MTYPEMSG = "C.O.D."
   ENDCASE
   @  1, 37  SAY "TYPE OF MAILING: "+MTYPEMSG
   @  2,  1  SAY TRIM(RCOMP_CITY)+", "+RCOMP_STAT+" "+RCOMP_ZIP
   @  2, 37  SAY "DATE:"+DTOC(PSDATE)+"  BATCH:"+STR(PSBATCH,2)+;
                "  PS FORM 3877"
   IF MMAIL_TYPE > "1"
      @  4,  1  SAY "  ARTICLE                                        POST-
   ELSE
      @  4,  1  SAY "  ARTICLE                                        POST-
   ENDIF
   @  5,  1  SAY "  NUMBER     NAME, STREET & P.O. ADDRESS   AGE     FEES
   @  6,  1  SAY "----------- ---------------------------- ------ ------ -
*                 123456789 123456789 123456789 123456789 123456789 12345678
*                           1         2         3         4         5
   LN = 7
   PG = PG + 1
ENDIF
@  LN,  1  SAY  ARTICLE_NM
@  LN, 13  SAY  NAME1
IF POSTAGE <> 0
   @  LN, 45  SAY  POSTAGE
ENDIF
@  LN, 50  SAY  FEE PICTURE "9999.99"
@  LN, 58  SAY  R_FEE + RESTR_FEE + TO_WHM_FEE PICTURE "999.99"
LTOT = POSTAGE+FEE+R_FEE
POSTTOT = POSTTOT + POSTAGE
FEESTOT = FEESTOT + FEE
RFEETOT = RFEETOT + R_FEE + RESTR_FEE + TO_WHM_FEE
IF MMAIL_TYPE > "1"
   @ LN,65 SAY VALUE PICTURE "999999999.99"
ENDIF
LN = LN + 1
MSG1 = ""
MSG2 = ""
```

```
   IF RESTR_FEE > 0
      MSG1 = "RESTRICTED"
   ENDIF
   IF TO_WHM_FEE > 0
      MSG2 = "SHOW TO WHOM"
   ENDIF
   IF NAME2 <> SPACE(30)
      @  LN, 13  SAY  NAME2
      IF LEN(MSG1) > 0
         @ LN,65 SAY MSG1
         MSG1 = ""
      ELSE
         @ LN,65 SAY MSG2
         MSG2 = ""
      ENDIF
      LN = LN + 1
   ENDIF
   IF ADDR1 <> SPACE(30)
      @  LN, 13  SAY  ADDR1
      IF LEN(MSG1) > 0
         @ LN,65 SAY MSG1
         MSG1 = ""
      ELSE
         @ LN,65 SAY MSG2
         MSG2 = ""
      ENDIF
      LN = LN + 1
   ENDIF
   IF ADDR2 <> SPACE(30)
      @  LN, 13  SAY  ADDR2
      IF LEN(MSG1) > 0
         @ LN,65 SAY MSG1
         MSG1 = ""
      ELSE
         @ LN,65 SAY MSG2
         MSG2 = ""
      ENDIF
      LN = LN + 1
   ENDIF
   IF ADDR3 <> SPACE(30)
      @  LN, 13  SAY  ADDR3
      IF LEN(MSG1) > 0
         @ LN,65 SAY MSG1
         MSG1 = ""
      ELSE
         @ LN,65 SAY MSG2
         MSG2 = ""
      ENDIF
      LN = LN + 1
   ENDIF
   @ LN, 13  SAY  TRIM(CITY)+", "+ST+" "+ZIP
   IF LEN(MSG1) > 0
      @ LN,65 SAY MSG1
      MSG1 = ""
   ELSE
      @ LN,65 SAY MSG2
      MSG2 = ""
   ENDIF
   LN = LN + 2
   CERTCNT = CERTCNT + 1
   SKIP
   MPRNTD = .T.
ENDDO
IF MPRNTD
   SAVE ALL LIKE PS* TO PS3877
   @ LN,44 SAY "------ ------ ------"
   LN = LN + 1
   @ LN,34 SAY "TOTALS:"
```

```
  @ LN,43 SAY POSTTOT PICTURE "9999.99"
  @ LN,50 SAY FEESTOT PICTURE "9999.99"
  @ LN,57 SAY RFEETOT PICTURE "9999.99"
  LN = LN + 3
  IF LN > 55
     @  1,  1  SAY "PAGE:"+LTRIM(STR(PG))
     @  1, 24  SAY "TYPE OF MAILING: CERTIFIED MAIL"
     @  2, 37  SAY "DATE:"+DTOC(PSDATE)+"  BATCH:"+STR(PSBATCH,2)+;
                   "  PS FORM 3877"
     LN = 5
  ENDIF
  IF LN < 55
     LN = 55
  ENDIF

  * PRINT BOTTOM OF FORM
  @ LN, 1    SAY "-----------------------------------------------------------------
  @ LN+1, 1 SAY "| TOTAL # OF | TOTAL # OF | POSTMASTER, PER:  | THE FULL DEC
  @ LN+2, 1 SAY "| PIECES     | PIECES     | (NAME OF RECEIVING | IS REQUIRED
  @ LN+3, 1 SAY "| LISTED BY  | RECEIVED AT | EMPLOYEE)          | AND INTERNAT
  @ LN+4, 1 SAY "| SENDER     | POST OFFICE |                    | MAIL. THE MA
  @ LN+5, 1 SAY "|            |            |                    | PAYABLE IS $
  @ LN+6, 6 SAY CERTCNT PICTURE "999"
  @ LN+6, 1 SAY "|            |            |                    | REGISTERED M
  @ LN+7, 1 SAY "-----------------------------------------------------------------
  @ 0,0 SAY "  "
ENDIF
SET DEVI TO SCRE
CLOSE DATA
RETURN

*************************************************************
* LISTPRNT.PRG - PRINT NAME LISTINGS REPORT                 *
*************************************************************
USE CERTMAIL
level4 = 1
MFILT = ""
MREPO = ""
DO WHILE (level4 # 0)
   CLEAR
   DO scrnhead
   SET MESSAGE TO 20 CENTER   && display MESSAGEs on line 20
   @ 22,10 to 24,69
   @ 23,12 SAY "Use <- -> or first letter of command, press ESC to EXIT."
   MLABL = "ALL NAME LISTING REPORT"
   @  7, 40-(LEN(MLABL)/2) SAY MLABL
   @  8, 14 TO 10,66

   *DEPT    OPER/UNIT    FILE NUM    ALL
   *22      30           43          55
   @  9, 22  PROMPT "DEPT"        MESSAGE "Print by Department"
   @  9, 30  PROMPT "OPER/UNIT"   MESSAGE "Print by Operator/Unit"
   @  9, 43  PROMPT "FILE NUM"    MESSAGE "Print by File Number"
   @  9, 55  PROMPT "ALL"         MESSAGE "Print all available files"

   MENU TO level4

   do case
   case level4=1
      *DEPT
      m_lt = 21
      do sub_menup with level5
      IF LEVEL5 = 0
         LOOP
      ENDIF
      mdept = SPACE(8)
      @ 16, 25 SAY "ENTER DEPARTMENT TO PRINT" GET mdept
      @ 17, 20 SAY "or leave blank to print all departments."
```

```
   READ
   IF MDEPT <> SPACE(8)
      MFILT = MFILT + ".AND. DEPT = '&mdept'"
   ENDIF
   SET INDE TO DEPT
   MREPO = "LISTNG1"+MREPO

case level4=2
   *OPER/UNIT
   m_lt = 29
   do sub_menup with level5
   IF LEVEL5 = 0
      LOOP
   ENDIF
   mopr = SPACE(5)
   @ 16, 26 SAY "ENTER OPER/UNIT TO PRINT" GET mopr
   @ 17, 21 SAY "or leave blank to print all oper/units"
   READ
   IF MOPR <> SPACE(5)
      MFILT = MFILT + ".AND. OPERATOR = '&mopr'"
   ENDIF
   @ 17,21 SAY "Please wait... sorting by operator/unit"
   INDEX ON OPERATOR TO OPER
   SET INDE TO OPER
   MREPO = "LISTNG2"+MREPO

case level4=3
   *FILE NUM
   m_lt = 42
   do sub_menup with level5
   IF LEVEL5 = 0
      LOOP
   ENDIF
   mfile = SPACE(25)
   @ 16, 14 SAY "ENTER FILE NUMBER TO PRINT" GET mfile
   @ 17, 23 SAY "or leave blank to print all files."
   READ
   IF MFILE <> SPACE(25)
      MFILT = MFILT + ".AND. FILE_NUM = '&mfile'"
   ENDIF
   SET INDE TO FILE
   MREPO = "LISTNG3"+MREPO

case level4=4
   *ALL
   m_lt = 54
   do sub_menup with level5
   IF LEVEL5 = 0
      LOOP
   ENDIF
   SET INDEX TO CERT
   MREPO = "LISTNG4"+MREPO
endcase

IF level4 <> 0
   MBDATE = CTOD("  /  /  ")
   MEDATE = CTOD("  /  /  ")
   @ 8, 0 CLEAR
   @  8, 10 TO 14, 70
   DUM = " "
   @  9, 18 SAY "ENTER STARTING MAIL DATE TO PRINT:" GET MBDATE
   @ 10, 18 SAY "ENTER ENDING MAIL DATE TO PRINT:  " GET MEDATE
   @ 11, 18 SAY "Or leave dates blank to print unmailed files"
   READ
   IF DTOC(MBDATE) = "  /  /  " .AND. DTOC(MEDATE) = "  /  /  "
      MFILT = MFILT + ' .AND. DTOC(MAILED) = "  /  /  "'
   ELSE
      MFILT = MFILT + " .AND. MAILED >= MBDATE .AND. MAILED <= MEDATE"
   ENDIF
```

```
      SET FILTER TO &MFILT
      scrnline = 12
      DO prntmsg
      IF .NOT. MPRNT
         RETURN
      ENDIF
      IF printopt = "S"
         REPO FORM &MREPO
         DUM = " "
         @ 24,18 SAY "Report Complete. Press any key to continue." GET DUM
         READ
      ENDIF
      IF printopt = "P"
         SET CONSO OFF
         MCOVR1 = "NAME LIST DETAIL REPORT"
         MCOVR2 = "FILES MAILED FROM "+DTOC(MBDATE)+" TO "+DTOC(MEDATE)
         SET DEVI TO PRINT
         @ 20, 40-(LEN(MCOVR1)/2) SAY MCOVR1
         @ 22, 40-(LEN(MCOVR2)/2) SAY MCOVR2
         @ 0,0 SAY " "
         SET DEVI TO SCRE
         REPO FORM &MREPO TO PRINT
         SET CONSO ON
      ENDIF
   ENDIF
ENDDO
CLOSE DATA
RETURN

*************************************************************
* RECTPRNT.PRG - PRINT UNRETURNED GREEN CARD REPORT         *
*************************************************************
USE CERTMAIL
level4 = 1
MFILT = ""
MREPO = ""
DO WHILE (level4 # 0)
   CLEAR
   DO scrnhead
   SET MESSAGE TO 20 CENTER   && display MESSAGEs on line 20
   @ 22,10 to 24,69
   @ 23,12 SAY "Use <- -> or first letter of command, press ESC to EXIT."
   MLABL = "UNRETURNED GREEN CARD REPORT"
   @  7, 40-(LEN(MLABL)/2) SAY MLABL
   @  8, 14 TO 10,66

   *DEPT    OPER/UNIT    FILE NUM    ALL
   *22      30           43          55
   @  9, 22  PROMPT "DEPT"        MESSAGE "Print by Department"
   @  9, 30  PROMPT "OPER/UNIT"   MESSAGE "Print by Operator/Unit"
   @  9, 43  PROMPT "FILE NUM"    MESSAGE "Print by File Number"
   @  9, 55  PROMPT "ALL"         MESSAGE "Print all available files"

   MENU TO level4

   do case
   case level4=1
      *DEPT
      m_lt = 21
      do sub_menup with level5
      IF LEVEL5 = 0
         LOOP
      ENDIF
      mdept = SPACE(8)
      @ 16, 25 SAY "ENTER DEPARTMENT TO PRINT" GET mdept
      @ 17, 20 SAY "or leave blank to print all departments."
      READ
```

```
   IF MDEPT <> SPACE(8)
      MFILT = MFILT + ".AND. DEPT = '&mdept'"
   ENDIF
   SET INDE TO DEPT
   MREPO = "RCTPRN1"+MREPO

case level4=2
   *OPER/UNIT
   m_lt = 29
   do sub_menup with level5
   IF LEVEL5 = 0
      LOOP
   ENDIF
   mopr = SPACE(5)
   @ 16, 26 SAY "ENTER OPER/UNIT TO PRINT" GET mopr
   @ 17, 21 SAY "or leave blank to print all oper/units"
   READ
   IF MOPR <> SPACE(5)
      MFILT = MFILT + ".AND. OPERATOR = '&mopr'"
   ENDIF
   @ 17,21 SAY "Please wait... sorting by operator/unit"
   INDEX ON OPERATOR TO OPER
   SET INDE TO OPER
   MREPO = "RCTPRN2"+MREPO

case level4=3
   *FILE NUM
   m_lt = 42
   do sub_menup with level5
   IF LEVEL5 = 0
      LOOP
   ENDIF
   mfile = SPACE(25)
   @ 16, 14 SAY "ENTER FILE NUMBER TO PRINT" GET mfile
   @ 17, 23 SAY "or leave blank to print all files."
   READ
   IF MFILE <> SPACE(25)
      MFILT = MFILT + ".AND. FILE_NUM = '&mfile'"
   ENDIF
   SET INDE TO FILE
   MREPO = "RCTPRN3"+MREPO

case level4=4
   *ALL
   m_lt = 54
   do sub_menup with level5
   IF LEVEL5 = 0
      LOOP
   ENDIF
   SET INDEX TO CERT
   MREPO = "RCTPRN4"+MREPO
endcase

IF level4 <> 0
   @  8, 0 CLEAR
   @  8, 10 TO 14, 70
   MDAYS = 0
   @  9, 20 SAY "ENTER MINIMUM DAYS FROM DATE MAILED ";
      GET MDAYS PICTURE "999"
   READ
   IF MDAYS = 0
      MFILT = MFILT + ".AND.DATE()-MAILED>0 "
   ELSE
      MFILT = MFILT + ".AND.DATE()-MAILED>MDAYS"
   ENDIF

   MFILT=MFILT+".AND.DTOC(MAILED)<>'  /  /  '.AND.DTOC(RECD) = '  /  /  '"
```

```
      SET FILTER TO &MFILT
      DUM = " "
      scrnline = 11
      DO prntmsg
      IF .NOT. MPRNT
         RETURN
      ENDIF
      IF printopt = "S"
         REPO FORM &MREPO
         DUM = " "
         @ 24,18 SAY "Report Complete. Press any key to continue." GET DUM
         READ
      ENDIF
      IF printopt = "P"
         SET CONSO OFF
         MCOVR1 = "UNRETURNED GREEN CARD REPORT"
         MCOVR2 = "MINIMUM DAYS FROM DATE MAILED: "+STR(MDAYS,3)
         SET DEVI TO PRINT
         @ 20, 40-(LEN(MCOVR1)/2) SAY MCOVR1
         @ 22, 40-(LEN(MCOVR2)/2) SAY MCOVR2
         @ 0,0 SAY " "
         SET DEVI TO SCRE
         REPO FORM &MREPO TO PRINT
         SET CONSO ON
      ENDIF
   ENDIF
ENDDO
CLOSE DATA
RETURN

*************************************************************
* DETLPRNT.PRG - PRINT POSTAGE DETAIL REPORT                *
*************************************************************
USE CERTMAIL
level4 = 1
MFILT = ""
MREPO = ""
DO WHILE (level4 # 0)
   CLEAR
   DO scrnhead
   SET MESSAGE TO 20 CENTER   && display MESSAGEs on line 20
   @ 22,10 to 24,69
   @ 23,12 SAY "Use <- -> or first letter of command, press ESC to EXIT."
   MLABL = "POSTAGE FEE DETAIL REPORT"
   @  7, 40-(LEN(MLABL)/2) SAY MLABL
   @  8, 14 TO 10,66

   *DEPT    OPER/UNIT    FILE NUM    ALL
   *22      30           43          55
   @  9, 22  PROMPT "DEPT"        MESSAGE "Print by Department"
   @  9, 30  PROMPT "OPER/UNIT"   MESSAGE "Print by Operator/Unit"
   @  9, 43  PROMPT "FILE NUM"    MESSAGE "Print by File Number"
   @  9, 55  PROMPT "ALL"         MESSAGE "Print all available files"

   MENU TO level4

   do case
   case level4=1
      *DEPT
      m_lt = 21
      do sub_menup with level5
      IF LEVEL5 = 0
         LOOP
      ENDIF
      mdept = SPACE(8)
      @ 16, 25 SAY "ENTER DEPARTMENT TO PRINT" GET mdept
      @ 17, 20 SAY "or leave blank to print all departments."
      READ
```

```
   IF MDEPT <> SPACE(8)
      MFILT = MFILT + ".AND. DEPT = '&mdept'"
   ENDIF
   SET INDE TO DEPT
   MREPO = "DETAIL1"+MREPO

case level4=2
   *OPER/UNIT
   m_lt = 29
   do sub_menup with level5
   IF LEVEL5 = 0
      LOOP
   ENDIF
   mopr = SPACE(5)
   @ 16, 26 SAY "ENTER OPER/UNIT TO PRINT" GET mopr
   @ 17, 21 SAY "or leave blank to print all oper/units"
   READ
   IF MOPR <> SPACE(5)
      MFILT = MFILT + ".AND. OPERATOR = '&mopr'"
   ENDIF
   @ 17,21 SAY "Please wait... sorting by operator/unit"
   INDEX ON OPERATOR TO OPER
   SET INDE TO OPER
   MREPO = "DETAIL2"+MREPO

case level4=3
   *FILE NUM
   m_lt = 42
   do sub_menup with level5
   IF LEVEL5 = 0
      LOOP
   ENDIF
   mfile = SPACE(25)
   @ 16, 14 SAY "ENTER FILE NUMBER TO PRINT" GET mfile
   @ 17, 23 SAY "or leave blank to print all files."
   READ
   IF MFILE <> SPACE(25)
      MFILT = MFILT + ".AND. FILE_NUM = '&mfile'"
   ENDIF
   SET INDE TO FILE
   MREPO = "DETAIL3"+MREPO

case level4=4
   *ALL
   m_lt = 54
   do sub_menup with level5
   IF LEVEL5 = 0
      LOOP
   ENDIF
   SET INDEX TO CERT
   MREPO = "DETAIL4"+MREPO
endcase

IF level4 <> 0
   MBDATE = DATE()
   MEDATE = DATE()
   @ 8, 0 CLEAR
   @  8, 10 TO 14, 70
   DUM = " "
   @  9, 18 SAY "ENTER STARTING MAIL DATE TO PRINT:" GET MBDATE
   @ 10, 18 SAY "ENTER ENDING MAIL DATE TO PRINT:  " GET MEDATE
   READ

   MFILT = MFILT + " .AND. MAILED >= MBDATE .AND. MAILED <= MEDATE"
   SET FILTER TO &MFILT
   scrnline = 12
   DO prntmsg
```

```
      IF .NOT. MPRNT
         RETURN
      ENDIF
      IF printopt = "S"
         REPO FORM &MREPO
         DUM = " "
         @ 24,18 SAY "Report Complete. Press any key to continue." GET DUM
         READ
      ENDIF
      IF printopt = "P"
         SET CONSO OFF
         MCOVR1 = "POSTAGE FEE DETAIL REPORT"
         MCOVR2 = "FILES MAILED FROM "+DTOC(MBDATE)+" TO "+DTOC(MEDATE)
         SET DEVI TO PRINT
         @ 20, 40-(LEN(MCOVR1)/2) SAY MCOVR1
         @ 22, 40-(LEN(MCOVR2)/2) SAY MCOVR2
         @ 0,0 SAY " "
         SET DEVI TO SCRE
         REPO FORM &MREPO TO PRINT
         SET CONSO ON
      ENDIF
   ENDIF
ENDDO
CLOSE DATA
RETURN

*************************************************************
* RETNPRNT.PRG - PRINT RETURN DISPOSITION REPORT            *
*************************************************************
USE CERTMAIL
level4 = 1
MFILT = ""
MREPO = ""
DO WHILE (level4 # 0)
   CLEAR
   DO scrnhead
   SET MESSAGE TO 20 CENTER   && display MESSAGEs on line 20
   @ 22,10 to 24,69
   @ 23,12 SAY "Use <- -> or first letter of command, press ESC to EXIT."
   MLABL = "RETURN DISPOSITION REPORT"
   @  7, 40-(LEN(MLABL)/2) SAY MLABL
   @  8, 14 TO 10,66

   *DEPT    OPER/UNIT    FILE NUM    ALL
   *22      30           43          55
   @  9, 22  PROMPT "DEPT"        MESSAGE "Print by Department"
   @  9, 30  PROMPT "OPER/UNIT"   MESSAGE "Print by Operator/Unit"
   @  9, 43  PROMPT "FILE NUM"    MESSAGE "Print by File Number"
   @  9, 55  PROMPT "ALL"         MESSAGE "Print all available files"

   MENU TO level4

   do case
   case level4=1
      *DEPT
      m_lt = 21
      do sub_menup with level5
      IF LEVEL5 = 0
         LOOP
      ENDIF
      mdept = SPACE(8)
      @ 16, 25 SAY "ENTER DEPARTMENT TO PRINT" GET mdept
      @ 17, 20 SAY "or leave blank to print all departments."
      READ
      IF MDEPT <> SPACE(8)
         MFILT = MFILT + ".AND. DEPT = '&mdept'"
      ENDIF
      SET INDE TO DEPT
      MREPO = "DISPOS1"+MREPO
```

```
case level4=2
   *OPER/UNIT
   m_lt = 29
   do sub_menup with level5
   IF LEVEL5 = 0
      LOOP
   ENDIF
   mopr = SPACE(5)
   @ 16, 26 SAY "ENTER OPER/UNIT TO PRINT" GET mopr
   @ 17, 21 SAY "or leave blank to print all oper/units"
   READ
   IF MOPR <> SPACE(5)
      MFILT = MFILT + ".AND. OPERATOR = '&mopr'"
   ENDIF
   @ 17,21 SAY "Please wait... sorting by operator/unit"
   INDEX ON OPERATOR TO OPER
   SET INDE TO OPER
   MREPO = "DISPOS2"+MREPO

case level4=3
   *FILE NUM
   m_lt = 42
   do sub_menup with level5
   IF LEVEL5 = 0
      LOOP
   ENDIF
   mfile = SPACE(25)
   @ 16, 14 SAY "ENTER FILE NUMBER TO PRINT" GET mfile
   @ 17, 23 SAY "or leave blank to print all files."
   READ
   IF MFILE <> SPACE(25)
      MFILT = MFILT + ".AND. FILE_NUM = '&mfile'"
   ENDIF
   SET INDE TO FILE
   MREPO = "DISPOS3"+MREPO

case level4=4
   *ALL
   m_lt = 54
   do sub_menup with level5
   IF LEVEL5 = 0
      LOOP
   ENDIF
   @ 17,21 SAY "Please wait... sorting by return codes."
   INDEX ON RETN_CODE TO RETN
   SET INDE TO RETN
   MREPO = "DISPOS4"+MREPO
endcase

IF level4 <> 0
   @ 8, 0 CLEAR
   @  8, 10 TO 14, 70
   MBDATE = DATE()
   MEDATE = DATE()
   @ 8, 0 CLEAR
   @  8, 10 TO 14, 70
   DUM = " "
   @  9, 18 SAY "ENTER STARTING MAIL DATE TO PRINT:" GET MBDATE
   @ 10, 18 SAY "ENTER ENDING MAIL DATE TO PRINT:  " GET MEDATE
   READ
   MFILT = MFILT + " .AND. MAILED >= MBDATE .AND. MAILED <= MEDATE .AND."+;
    'DTOC(RECD) <> "  /  /  "'
   SET FILTER TO &MFILT
   DUM = " "
   scrnline = 12
   DO prntmsg
```

```
      IF .NOT. MPRNT
         RETURN
      ENDIF
      IF printopt = "S"
         REPO FORM &MREPO
         DUM = " "
         @ 24,18 SAY "Report Complete. Press any key to continue." GET DUM
         READ
      ENDIF
      IF printopt = "P"
         SET CONSO OFF
         MCOVR1 = "RETURN DISPOSITION REPORT"
         MCOVR2 = "FILES MAILED FROM "+DTOC(MBDATE)+" TO "+DTOC(MEDATE)
         SET DEVI TO PRINT
         @ 20, 40-(LEN(MCOVR1)/2) SAY MCOVR1
         @ 22, 40-(LEN(MCOVR2)/2) SAY MCOVR2
         @ 0,0 SAY " "
         SET DEVI TO SCRE
         REPO FORM &MREPO TO PRINT
         SET CONSO ON
      ENDIF
   ENDIF
ENDDO
CLOSE DATA
RETURN

*****************************************************************************
* CODEMAIL.PRG - ADD/CHG/DEL SIDE FILES
*****************************************************************************

level3 = 1
DO WHILE (level3 # 0)
   DO scrnhead
   SET MESSAGE TO 20 CENTER   && display MESSAGEs on line 20
   @ 22,10 to 24,69
   @ 23,12 SAY "Use <- -> or first letter of command, press ESC to EXIT."
   MLABL = "SIDE FILE MAINTENANCE"
   @  7, 40-(LEN(MLABL)/2) SAY MLABL
   @  8, 20 TO 10,60

*ADD    CHANGE    DELETE    LIST
*24     31        41        51

   @  9, 24  PROMPT "ADD"       MESSAGE "Add Codes to File"
   @  9, 31  PROMPT "CHANGE"    MESSAGE "Change Existing Codes"
   @  9, 41  PROMPT "DELETE"    MESSAGE "Delete Codes"
   @  9, 51  PROMPT "LIST"      MESSAGE "Print a Listing of Side File Codes"

   MENU TO level3

   do case

*********************** SIDE FILE ADD PROGRAM *************************
   case level3=1
      DO scrnhead
      @  6,28 TO 8,54 DOUBLE
      @  7, 30  SAY "SIDE FILE ENTRY SCREEN"
      MCODE = SPACE(8)
      @ 10, 24 SAY "ENTER CODE NUMBER TO ADD" GET MCODE
      @ 11, 24 SAY "Or leave blank to return to menu"
      READ
      IF MCODE = SPACE(8)
         LOOP
      ENDIF

      MFILE  = SPACE(25)
      MADDR1 = SPACE(30)
      MADDR2 = SPACE(30)
```

```
   MADDR3 = SPACE(30)
   MCITY  = SPACE(20)
   MNAME1 = SPACE(30)
   MNAME2 = SPACE(30)
   MST    = SPACE(2)
   MZIP   = SPACE(10)
   MDEPT  = SPACE(8)
   MOPERATOR = SPACE(5)

   USE SIDEFILE
   SET INDE TO CODE
   MCODE = TRIM(MCODE)
   MCONT = .T.
DO WHILE MCONT
   DO scrnhead
   @  6, 30  SAY "SIDE FILE ENTRY SCREEN"
   @  7, 20  TO 19, 62
   @  8, 22  SAY "Code"
   @ 10, 22  SAY "Dept."
   @ 10, 37  SAY "Oper/Unit"
   @ 11, 22  SAY "File Num"
   @ 12, 22  SAY "Name"
   @ 13, 22  SAY "Name"
   @ 14, 22  SAY "Address"
   @ 15, 22  SAY "Address"
   @ 16, 22  SAY "Address"
   @ 17, 22  SAY "City"
   @ 18, 22  SAY "State"
   @ 18, 37  SAY "Zip"
   @  8, 31  SAY  MCODE
   @ 10, 28  GET  MDEPT
   @ 10, 47  GET  MOPERATOR
   @ 11, 31  GET  MFILE
   @ 12, 31  GET  MNAME1
   @ 13, 31  GET  MNAME2
   @ 14, 31  GET  MADDR1
   @ 15, 31  GET  MADDR2
   @ 16, 31  GET  MADDR3
   @ 17, 31  GET  MCITY
   @ 18, 31  GET  MST
   @ 18, 41  GET  MZIP
   @ 21,0 CLEAR TO 23,79
   READ

   @ 23,0 CLEAR
   SET COLO TO I
   @ 23, 2  SAY "<PgDn> ADD ANOTHER,  <Home> START OVER,"+;
                " <End> EXIT/SAVE, <Esc> EXIT/NO SAVE"
   SET COLO TO W+/B
   DO GETKEY
   DO CASE
   CASE MKEY = "H"
      * <HOME>
      LOOP
   CASE MKEY = "E"
      * <ESC>
      MGOOD = .F.
      MCONT = .F.
   CASE MKEY = "D"
      * <PG DN>
      MGOOD = .T.
      MCONT = .T.
   CASE MKEY = "N"
      * <END>
      MGOOD = .T.
      MCONT = .F.
   ENDCASE
   IF MGOOD
```

```
            IF MNAME1 <> SPACE(30)
               APPE BLANK
               REPLACE ADDR1 WITH MADDR1,ADDR2 WITH MADDR2,ADDR3 WITH MADDR3
               REPLACE CITY WITH MCITY, FILE_NUM WITH MFILE,NAME1 WITH MNAME1
               REPLACE NAME2 WITH MNAME2,ST WITH MST,ZIP WITH MZIP
               REPLACE DEPT WITH MDEPT,OPERATOR WITH MOPERATOR,CODE WITH MCODE
            ENDIF
         ENDIF
         IF MCONT
            MADDR1 = SPACE(30)
            MADDR2 = SPACE(30)
            MADDR3 = SPACE(30)
            MCITY  = SPACE(20)
            MNAME1 = SPACE(30)
            MNAME2 = SPACE(30)
            MST    = SPACE(2)
            MZIP   = SPACE(10)
            MDEPT  = SPACE(8)
            MOPERATOR = SPACE(5)
         ENDIF
      ENDDO

********************** SIDE FILE CHANGE PROGRAM **************************
   case level3=2
      DO scrnhead
      @  6,28 TO 8,54 DOUBLE
      @  7, 29  SAY "SIDE FILE CHANGE SCREEN"
      MCODE = SPACE(8)
      @ 10, 22 SAY "ENTER CODE NUMBER TO CHANGE " GET MCODE
      @ 11, 24 SAY "Or leave blank to return to menu"
      READ
      IF MCODE = SPACE(8)
         LOOP
      ENDIF
      USE SIDEFILE
      SET INDE TO CODE
      MCODE = TRIM(MCODE)
      FIND &MCODE
      IF FOUND()
         MCONT = .T.
         DO WHILE MCONT .AND. .NOT. EOF() .AND. CODE = MCODE
            DO scrnhead
            MCODE = CODE
            MDEPT = DEPT
            MOPER = OPERATOR
            MFILE = FILE_NUM
            MNAM1 = NAME1
            MNAM2 = NAME2
            MADR1 = ADDR1
            MADR2 = ADDR2
            MADR3 = ADDR3
            MCITY = CITY
            MSTAT = ST
            MZIP  = ZIP
            @  6, 29  SAY "SIDE FILE CHANGE SCREEN"
            @  7, 20  TO 19, 62
            @  8, 22  SAY "Code"
            @ 10, 22  SAY "Dept."
            @ 10, 37  SAY "Oper/Unit"
            @ 11, 22  SAY "File Num"
            @ 12, 22  SAY "Name"
            @ 13, 22  SAY "Name"
            @ 14, 22  SAY "Address"
            @ 15, 22  SAY "Address"
            @ 16, 22  SAY "Address"
            @ 17, 22  SAY "City"
            @ 18, 22  SAY "State"
            @ 18, 37  SAY "Zip"
```

```
            @  8, 27  SAY  CODE
            @ 10, 28  GET  MDEPT
            @ 10, 47  GET  MOPER
            @ 11, 31  GET  MFILE
            @ 12, 31  GET  MNAM1
            @ 13, 31  GET  MNAM2
            @ 14, 31  GET  MADR1
            @ 15, 31  GET  MADR2
            @ 16, 31  GET  MADR3
            @ 17, 31  GET  MCITY
            @ 18, 31  GET  MSTAT
            @ 18, 41  GET  MZIP
            @ 20, 21  SAY "<PgDn> to proceed to next name or exit"
            READ
            @ 23,0 CLEAR
            SET COLO TO I
            @ 23, 3  SAY "<PgDn> NEXT NAME,  <Home> START OVER,"+;
                 " <End> EXIT/SAVE, <Esc> EXIT/NO SAVE"
            SET COLO TO W+/B
            DO GETKEY
            DO CASE
            CASE MKEY = "H"
               * <HOME>
               LOOP
            CASE MKEY = "E"
               * <ESC>
               MGOOD = .F.
               MCONT = .F.
            CASE MKEY = "D"
               * <PG DN>
               MGOOD = .T.
               MCONT = .T.
            CASE MKEY = "N"
               * <END>
               MGOOD = .T.
               MCONT = .F.
            ENDCASE
            @ 21, 0 CLEAR TO 23, 79
            IF MGOOD
               IF MNAM1 <> SPACE(30)
                  REPL FILE_NUM WITH MFILE,DEPT WITH MDEPT
                  REPL OPERATOR WITH MOPER,NAME1 WITH MNAM1,NAME2 WITH MNAM2
                  REPL ADDR1 WITH MADR1,ADDR2 WITH MADR2,ADDR3 WITH MADR3
                  REPL CITY WITH MCITY,ST WITH MSTAT,ZIP WITH MZIP
               ENDIF
            ENDIF
            SKIP
         ENDDO
         IF MCONT
            DUM = " "
            @ 21,0 CLEAR TO 23,79
            @ 21,27 SAY "NO MORE NAMES FOR THIS CODE"
            @ 22,27 SAY "PRESS A KEY TO CONTINUE: " GET DUM
            READ
         ENDIF
      ELSE
         DUM = " "
         @ 21,0 CLEAR TO 23,79
         @ 21,30 SAY "CAN'T FIND THAT CODE"
         @ 22,27 SAY "PRESS A KEY TO CONTINUE: " GET DUM
         READ
      ENDIF

********************** SIDE FILE DELETE PROGRAM **************************
   case level3=3
      DO scrnhead
      @  6,28 TO 8,54 DOUBLE
      @  6, 29  SAY "SIDE FILE DELETE SCREEN"
```

```
MCODE = SPACE(8)
@ 10, 22 SAY "ENTER CODE NUMBER TO DELETE " GET MCODE
@ 11, 24 SAY "Or leave blank to return to menu"
READ
IF MCODE = SPACE(8)
   LOOP
ENDIF
MPACK = .F.
USE SIDEFILE
SET INDE TO CODE
MCODE = TRIM(MCODE)
FIND &MCODE
IF FOUND()
   MDELE = " "
   DO WHILE MDELE <> "X" .AND. .NOT. EOF() .AND. CODE = MCODE
      DO scrnhead
      @  6, 29  SAY "SIDE FILE DELETE SCREEN"
      @  7, 20  TO 19, 62
      @  8, 22  SAY "Code"
      @ 10, 22  SAY "Dept."
      @ 10, 37  SAY "Oper/Unit"
      @ 11, 22  SAY "File Num"
      @ 12, 22  SAY "Name"
      @ 13, 22  SAY "Name"
      @ 14, 22  SAY "Address"
      @ 15, 22  SAY "Address"
      @ 16, 22  SAY "Address"
      @ 17, 22  SAY "City"
      @ 18, 22  SAY "State"
      @ 18, 37  SAY "Zip"
      @  8, 31  SAY  CODE
      @ 10, 28  SAY  DEPT
      @ 10, 47  SAY  OPERATOR
      @ 11, 31  SAY  FILE_NUM
      @ 12, 31  SAY  NAME1
      @ 13, 31  SAY  NAME2
      @ 14, 31  SAY  ADDR1
      @ 15, 31  SAY  ADDR2
      @ 16, 31  SAY  ADDR3
      @ 17, 31  SAY  CITY
      @ 18, 31  SAY  ST
      @ 18, 41  SAY  ZIP
      @ 21, 0 CLEAR TO 23,79
      MDELE = " "
      DO WHILE .NOT. MDELE$"ADSX"
      @ 21,14 SAY "S to SEARCH for another name, D to DELETE this name,"
      @ 22,14 SAY "A to DELETE ALL for this CODE, or X to EXIT to MENU ";
              GET MDELE PICT "!"
      READ
      ENDDO
      @ 21, 0 CLEAR TO 23,79
      IF MDELE = "S"
         SKIP
      ENDIF
      IF MDELE = "D"
         DELETE
         MPACK = .T.
         SKIP
      ENDIF
      IF MDELE = "A"
         DALL = .F.
         @ 23,33 SAY "ARE YOU SURE? " GET DALL PICT "Y"
         READ
         @ 21, 0 CLEAR TO 23,79
         IF DALL
            MPACK = .T.
            DO WHILE CODE = MCODE .AND. .NOT. EOF()
               DELETE
```

```
                SKIP
              ENDDO
            ENDIF
            MDELE = "X"
          ENDIF
        ENDDO
        IF MDELE <> "X" .AND. MDELE <> "A"
          DUM = " "
          @ 21,0 CLEAR TO 23,79
          @ 21,27 SAY "NO MORE NAMES FOR THIS CODE"
          @ 22,27 SAY "PRESS A KEY TO CONTINUE: " GET DUM
          READ
        ENDIF
      ELSE
        DUM = " "
          @ 21,0 CLEAR TO 23,79
          @ 21,30 SAY "CAN'T FIND THAT CODE"
          @ 22,27 SAY "PRESS A KEY TO CONTINUE: " GET DUM
          READ
        ENDIF
        IF MPACK
          @ 21,20 SAY "Please wait ... deleting marked files ..."
          PACK
        ENDIF

************************ SIDE FILE PRINT PROGRAM **************************
      case level3=4

        SET MESSAGE TO 21 CENTER   && display MESSAGEs on line 21
        @ 10,50 TO 13,62 DOUBLE
        @ 11,51  PROMPT "ALL CODES"    MESSAGE "Print all names for all codes"
        @ 12,51  PROMPT "SINGLE CODE"  MESSAGE "Print all names for one code"
        MENU TO level4
        DO scrnhead

        DO CASE
        case level4=1
          PRNTTYPE = 1

        case level4=2
          PRNTTYPE = 2
          @  5, 31  SAY "SIDE FILE LISTINGS"
          MCODE = SPACE(8)
          @  7, 20 SAY "ENTER CODE TO LIST " GET MCODE
          READ
          IF MCODE = SPACE(8)
            LOOP
          ENDIF

        ENDCASE

        DO scrnhead
        @  6, 10 TO 11, 70
        @  6, 29 SAY " PRINT SIDE FILE NAMES "

        USE SIDEFILE
        SET INDE TO CODE

        scrnline = 8
        DO prntmsg
        IF .NOT. MPRNT
          RETURN
        ENDIF
        IF printopt = "S" .AND. PRNTTYPE = 1
          REPO FORM SIDE01
        ENDIF
        IF printopt = "S" .AND. PRNTTYPE = 2
          REPO FORM SIDE01 FOR CODE = '&MCODE'
```

```
        ENDIF
        IF printopt = "S"
        DUM = " "
        @ 24,18 SAY "Report Complete. Press any key to continue." GET DUM
        READ
      ENDIF
      IF printopt = "P" .AND. PRNTTYPE = 1
         REPO FORM SIDE01 TO PRINT
      ENDIF
      IF printopt = "P" .AND. PRNTTYPE = 2
         REPO FORM SIDE01 FOR CODE = '&MCODE' TO PRINT
      ENDIF
      SET CONSO ON
   ENDCASE
   CLOSE DATA
ENDDO

*****************************************************************************
* PROCEDURE RETNCODE.PRG - EDIT RETURN CODE DESCRIPTIONS
*****************************************************************************
SELECT 1
USE RETNCODE
INDEX ON CODE TO RETNCODE
SET DELETED ON
*
cur_el = 1
rel_row = 0
ret_row = 0
REC_CNT = 0
MPACK = .F.

RETN_DESC = .T.
DO WHILE RETN_DESC
   CLEAR
   DO scrnhead
   @ 22,10 to 24,69
   @ 23,13 SAY "Use Up/Dn arrow or first letter of code to choose code"
   MLABL = "RETURN CODE MAINTENANCE"
   @  7, 40-(LEN(MLABL)/2) SAY MLABL
   @  6, 20 TO 8,60
   COUNT FOR .NOT. DELETED() TO REC_CNT
   DECLARE M_LINE[REC_CNT], M_REC[REC_CNT]

   @  9, 22  SAY "Code          Description"
   @ 10, 20 TO 19,60
   *
   GO TOP
   I = 1
   DO WHILE .NOT. EOF()
      IF .NOT. DELETED()
         M_LINE[I] = CODE+"  "+DESCRIP
         M_REC[I] = RECNO()
         I = I + 1
      ENDIF
      SKIP
   ENDDO
   *
   @ 20, 17 SAY "<F2> Add, <F3> Change, <F4> Delete, <ESC> Exit"
   *
   top=11
   lt=23
   bot=18
   rt=57
   edit_type = 0

   ***********************************************************************
   N = ACHOICE(top, lt, bot, rt, M_LINE, .T., "fn_adesedt", cur_el, rel_row)
   ***********************************************************************
```

```
DO CASE
CASE EDIT_TYPE = 0
* exit out
   RETN_DESC = .F.

CASE EDIT_TYPE = 1
   * add description
   MADD = .T.
   SAVE SCREEN TO RETNCODE
   DO WHILE MADD
      M_DESCRIP = SPACE(30)
      M_CODE = SPACE(3)
      @ 12, 22 CLEAR TO 12,58
      @ 11, 22 TO 13, 58
      @ 12, 23  GET M_CODE
      @ 12, 27  GET M_DESCRIP
      READ

      * ADD THE RECORD TO THE FILE
      IF M_CODE <> " "
         FIND &M_CODE
         IF FOUND()
            @ 20,0 CLEAR
            ? CHR(7)
            @ 20, 28 SAY "THAT CODE ALREADY EXISTS"
            LOOP
         ENDIF
         APPEND BLANK
         REPLACE CODE WITH M_CODE
         REPLACE DESCRIP WITH M_DESCRIP
      ENDIF
      MADD = .F.
   ENDDO
   RESTORE SCREEN FROM RETNCODE

CASE EDIT_TYPE = 2
   * change description
   GOTO M_REC[N]
   M_CODE = CODE
   M_DESCRIP = DESCRIP
   MADD = .T.
   SAVE SCREEN TO RETNCODE
   DO WHILE MADD
      @ 12, 22 CLEAR TO 12,58
      @ 11, 22 TO 13, 58
      @ 12, 23  SAY M_CODE
      @ 12, 27  GET M_DESCRIP
      READ
      REPLACE CODE WITH M_CODE
      REPLACE DESCRIP WITH M_DESCRIP
      MADD = .F.
   ENDDO
   RESTORE SCREEN FROM RETNCODE
   rel_row = ret_row
   cur_el = N

CASE EDIT_TYPE = 3
   * delete description
   MDEL = .F.
   GOTO M_REC[N]
   MSG = "DELETE CODE "+TRIM(CODE)+"?"
   @ 18,21 CLEAR TO 18,59
   @ 18, (40-(LEN(MSG)+2)/2) SAY MSG GET MDEL PICTURE "Y"
   READ
   rel_row = ret_row
   cur_el = N
   IF MDEL
      DELETE
```

```
        MPACK = .T.
        rel_row = 1
        cur_el  = 1
      ENDIF

   ENDCASE
ENDDO
IF MPACK
   PACK
ENDIF
RETURN

*****************************************************************************
*       FN_ADESEDIT()
*       achoice UDF for selecting advance codes
*****************************************************************************
FUNCTION fn_adesedt
PARAMETERS amod, sel, rel
PRIVATE r,keystroke,AMOD,SEL,REL
ret_row = rel

IF M->amod = 4
        * nothing selectable
  EDIT_TYPE = 0
        r = 0
ELSE
        * assume continue
        r = 2
        * get latest keystroke
        keystroke = LASTKEY()
ENDIF

IF M->amod = 3
   * keystroke exception
   DO CASE
   CASE keystroke = 27
      * escape..abort
      edit_type = 0
      r = 0
   CASE keystroke = -1
      * F2 key is pressed to add description
      edit_type = 1
      r = 1

   CASE keystroke = -2
      * F3 key is pressed to edit description
      edit_type = 2
      r = 1

   CASE keystroke = -3
      * F3 key is pressed to delete description
      edit_type = 3
      r = 1

   CASE keystroke > 64 .AND. keystroke < 123
      *
      edit_type = 0
      r = 3
ENDCASE
ENDIF

RETURN M->r
* EOFUNC FN_AEDIT
*************************************************************
* DELEMAIL.PRG - DELETE FILES FOR CERTIFIED MAIL PROGRAM    *
*************************************************************
```

```
level3 = 1
level4 = 1
DO WHILE (level3 # 0)
   DO scrnhead
   SET MESSAGE TO 20 CENTER   && display MESSAGEs on line 20
   @ 22,10 to 24,69
   @ 23,12 SAY "Use <- -> or first letter of command, press ESC to EXIT."
   MLABL = "DELETION MENU"
   @  7, 40-(LEN(MLABL)/2) SAY MLABL
   @  8, 20 TO 10,60

   @  9, 25  PROMPT "DELETE" MESSAGE "Remove all files marked for Deletion"
   @  9, 35  PROMPT "LIST"   MESSAGE "List all files marked for Deletion"
   @  9, 43  PROMPT "MARK"   MESSAGE "Mark files for Deletion"
   @  9, 51  PROMPT "SAVE"   MESSAGE "Save files marked for Deletion"

   MENU TO level3

   use certmail

   do case
   case level3=1
      * PACK DATA (PERFORM DELETION)
      DO scrnhead
      @  7,  5  TO  15, 73
      @  6, 32  SAY "MAILING DELETION"
      DUM = .F.
      ? CHR(7)
      @  9, 18 SAY "YOU ARE ABOUT TO DELETE DATA FROM THE FILE!!"
      @ 11, 17 SAY "HAVE YOU RUN A REPORT OF DELETE MARKED FILES? ";
         GET DUM PICT "Y"
      read
      IF .NOT. DUM
         LOOP
      ENDIF
      DUM = .F.
      @  9, 17 CLEAR TO 13,70
      ? CHR(7)
      @  9, 21 SAY "THIS IS YOUR LAST CHANCE TO BACK OUT!!"
      @ 11, 18 SAY "ARE YOU SURE YOU WANT TO PROCEED WITH THIS? ";
            GET DUM PICT "Y"
      read
      IF .NOT. DUM
         LOOP
      ENDIF
      DUM = " "
      @ 12,30 SAY "PRESS D TO DELETE" GET DUM
      READ
      IF UPPER(DUM) <> "D"
         LOOP
      ENDIF
      SET COLO TO W+*/B
      @ 14,22 SAY "DELETION IN PROGRESS, PLEASE WAIT..."
      SET COLOR TO W+/B
      PACK
      DELE FILE CERT.NTX
      INDEX ON ARTICLE_NM TO CERT
      SET INDE TO
      DELE FILE FILE.NTX
      INDEX ON FILE_NUM TO FILE
      SET INDE TO
      DELE FILE DEPT.NTX
      INDEX ON DEPT TO DEPT
      SET INDE TO
      DELE FILE NAME.NTX
      INDEX ON NAME1 TO NAME
      close data
```

```
case level3=2
   * PRINT A LIST OF FILES MARKED FOR DELETION
   SET INDE:  ) CERT
   DO scrnhe..
   @  6, 20  SAY "LISTING OF FILES MARKED FOR DELETION"
   @  7,  5  TO  15, 73

   scrnline = 10
   DO prntmsg
   IF .NOT. MPRNT
      RETURN
   ENDIF
   IF printopt = "S"
     REPO FORM DELETION FOR DELETED()
     DUM = " "
     @ 24,18 SAY "Report Complete. Press any key to continue " GET DUM
     READ
   ENDIF
   IF printopt = "P"
      REPO FORM DELETION FOR DELETED() TO PRINT
   ENDIF
   SET CONS ON
   close data

case level3=3
   * MARK FILES
   @ 10,42 TO 13,52 DOUBLE
   @ 11,43  PROMPT "ARTICLE #"  MESSAGE "Delete by Article Number"
   @ 12,43  PROMPT "DATE"       MESSAGE "Delete by mailed date"
   MENU TO leveld
   DO CASE
   CASE leveld=1
      DUM = " " .
      DO scrnhead
      SET INDEX TO CERT
      @  7,  5  TO  15, 73
      @  6, 32  SAY "MAILING DELETION"
      MDELETD = .F.
    DO WHILE .NOT. MDELETD
       MCERT = SPACE(10)
       @  8, 19  SAY "ENTER THE ARTICLE NUMBER TO DELETE" GET MCERT
       @  9, 24  SAY "Or leave blank to return to menu"
       READ
       IF MCERT = SPACE(10)
          MDELETD = .T.
          LOOP
       ENDIF
       FIND &MCERT
       DUM = " "
       IF FOUND()
          @ 11, 31 SAY "PRESS M TO MARK " GET DUM PICTURE "!"
          READ
          @ 11, 30 CLEAR TO 11,55
          IF DUM = "M"
             DELETE
          ENDIF
       ELSE
          @ 11, 17 SAY "FILE NOT FOUND!!  PRESS ANY KEY TO CONTINUE ";
             GET DU
          READ
       ENDIF
    ENDDO

 CASE leveld=2
    DO scrnhead
    SET INDEX TO CERT
    @  7,  5  TO  15, 73
    @  6, 32  SAY "MAILING DELETION"
```

```
      MDATE = CTOD("  /  /  ")
      @  8, 19  SAY "DELETE FILES MAILED PRIOR TO " GET MDATE
      READ
      IF DTOC(MDATE) = "  /  /  "
         LOOP
      ENDIF
      @ 11, 31 SAY "PRESS M TO MARK " GET DUM PICTURE "!"
      READ
      @ 11, 30 CLEAR TO 11,55
      IF DUM = "M"
         DELE FOR DTOC(MAILED) <> "  /  /  " .AND. MAILED < MDATE
      ENDIF

   ENDCASE
   CLOSE DATA

case level3=4
   * SAVE MARKED FILES
   DO scrnhead
   SET INDEX TO CERT
   @  7,  5  TO  15, 73
   @  6, 32  SAY "MAILING DELETION"
   MARTICLE = SPACE(10)
   @  9, 23  SAY "ENTER THE ARTICLE NUMBER TO SAVE OR"
   @ 10, 19  SAY "ENTER 99 TO SAVE EVERYTHING" GET MARTICLE
      READ
      IF MARTICLE = SPACE(10)
         LOOP
      ENDIF
      IF MARTICLE = "99"
         @ 12, 20  SAY "UNMARKING DELETED FILES.  PLEASE WAIT..."
         RECALL ALL
         LOOP
      ELSE
         SEEK MARTICLE
         DUM = " "
         IF .NOT. FOUND()
            DUM = " "
            @ 12, 27 SAY "CAN'T FIND THAT ARTICLE NUMBER"
            @ 13, 24 SAY "PRESS ANY KEY TO RETURN TO MENU" GET DUM
            READ
            LOOP
         ELSE
            RECALL
         ENDIF
      ENDIF
      close data
   endcase
enddo
DO CASE
CASE MMAIL_TYPE = "2"
   DO CASE
   CASE MVAL > 15000000
      MFEE = 0
   CASE MVAL > 1000000
      MFEE = 357.5
      MTMPVAL = MVAL - 1000000
      MTMPVAL = MTMPVAL / 1000
      MTMPMOD = MTMPVAL - INT(MTMPVAL)
      MTMPVAL = INT(MTMPVAL)
      MFEE = MFEE + (.25 * MTMPVAL)
      IF MTMPMOD > 0
         MFEE = MFEE + .25
      ENDIF
   CASE MVAL > 25000
      MFEE = 16.25
      MTMPVAL = MVAL - 25000
      MTMPVAL = MTMPVAL / 1000
```

```
      MTMPMOD = MTMPVAL - INT(MTMPVAL)
      MTMPVAL = INT(MTMPVAL)
      MFEE = MFEE + (.35 * MTMPVAL)
      IF MTMPMOD > 0
         MFEE = MFEE + .35
      ENDIF
   CASE MVAL > 24000
      MFEE = 16.25
   CASE MVAL > 23000
      MFEE = 15.75
   CASE MVAL > 22000
      MFEE = 15.25
   CASE MVAL > 21000
      MFEE = 14.75
   CASE MVAL > 20000
      MFEE = 14.25
   CASE MVAL > 19000
      MFEE = 13.75
   CASE MVAL > 18000
      MFEE = 13.25
   CASE MVAL > 17000
      MFEE = 12.85
   CASE MVAL > 16000
      MFEE = 12.35
   CASE MVAL > 15000
      MFEE = 11.85
   CASE MVAL > 14000
      MFEE = 11.40
   CASE MVAL > 13000
      MFEE = 10.90
   CASE MVAL > 12000
      MFEE = 10.45
   CASE MVAL > 11000
      MFEE = 9.95
   CASE MVAL > 10000
      MFEE = 9.50
   CASE MVAL > 9000
      MFEE = 9.00
   CASE MVAL > 8000
      MFEE = 8.55
   CASE MVAL > 7000
      MFEE = 8.10
   CASE MVAL > 6000
      MFEE = 7.65
   CASE MVAL > 5000
      MFEE = 7.25
   CASE MVAL > 4000
      MFEE = 6.85
   CASE MVAL > 3000
      MFEE = 6.45
   CASE MVAL > 2000
      MFEE = 6.05
   CASE MVAL > 1000
      MFEE = 5.65
   CASE MVAL > 500
      MFEE = 5.25
   CASE MVAL > 100
      MFEE = 4.85
   CASE MVAL > 0
      MFEE = 4.50
   ENDCASE

CASE MMAIL_TYPE = "3"
   DO CASE
   CASE MVAL > 15000000
      MFEE = 0
   CASE MVAL > 1000000
      MFEE = 353.9
```

```
    MTMPVAL = MVAL - 1000000
    MTMPVAL = MTMPVAL / 1000
    MTMPMOD = MTMPVAL - INT(MTMPVAL)
    MTMPVAL = INT(MTMPVAL)
    MFEE = MFEE + (.25 * MTMPVAL)
    IF MTMPMOD > 0
       MFEE = MFEE + .25
    ENDIF
CASE MVAL > 25000
    MFEE = 12.65
    MTMPVAL = MVAL - 25000
    MTMPVAL = MTMPVAL / 1000
    MTMPMOD = MTMPVAL - INT(MTMPVAL)
    MTMPVAL = INT(MTMPVAL)
    MFEE = MFEE + (.35 * MTMPVAL)
    IF MTMPMOD > 0
       MFEE = MFEE + .35
    ENDIF
CASE MVAL > 24000
   MFEE = 12.65
CASE MVAL > 23000
   MFEE = 12.30
CASE MVAL > 22000
```

The operation of the system will now be explained in more detail with the reference to the flow diagrams of FIGS. 8 to 14. In order to operate the program the operator uses a personal computer of the IBM or IBM compatible type with a hard disk drive with at least 500 k bytes available for the system. The computer must have at least 320 k bytes of available memory. The program needs DOS Version 3.0 or above, and may conveniently be provided on a floppy diskette containing the system operating program, several required data files, for example tables of postage fees for various services and insurance fees, and a number of report files. Since the thickness of the continuous mail forms to be used in the printer or printers is mandated by postal service requirements, and will typically be thicker than standard printer paper, a printer having a suggested maximum thickness greater than the form thickness should be selected. Either letter quality or dot matrix printers may be used.

In order to prepare a series of mailing labels and return receipts for registered, certified, or any other type of tracked mailing, the operator first loads the desired type of continuous mailing form into the printer, where only one printer unit is available, or alternatively selects the printer unit in which the desired form is loaded, in the case where multiple printer units are available. In the described embodiment, this is done by the operator manually switching between the units. However, this function may alternatively be provided automatically in the software according to the type of mailing selected by the operator from an on-screen menu.

Figure 13:
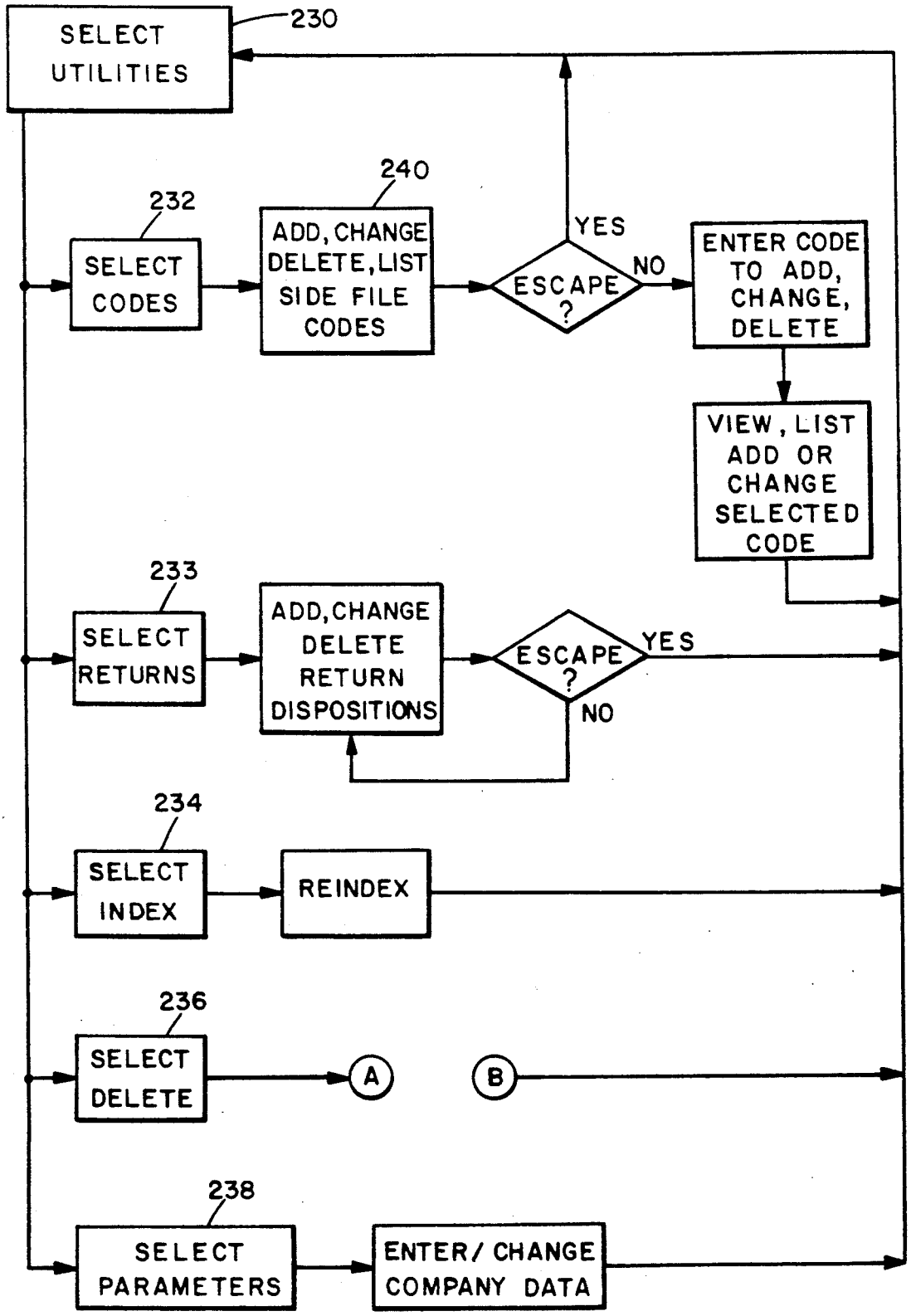
Figure 14:
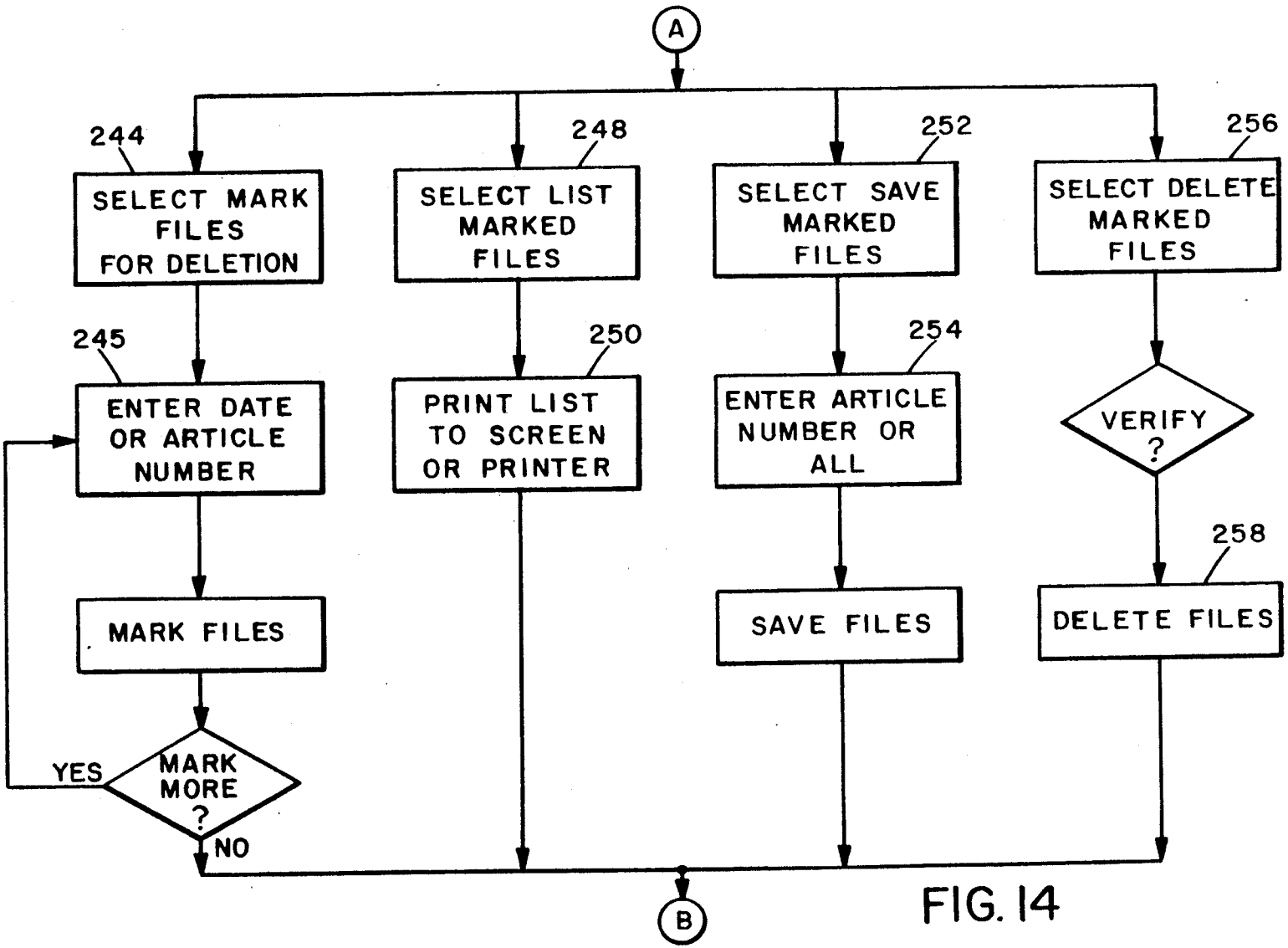

The software program is menu driven so that the operator of the program may perform program functions based on single keystroke menu commands. The user initiates the program by entering MAILINGS at the DOS prompt. The five main menu selections will then be displayed on the screen. These selections are ADD (FIG. 8), SEARCH (FIG. 9), RETURNS (FIG. 10), PRINT (FIGS. 11 and 12) and UTILITIES (FIGS. 13 and 14). When a user wishes to prepare labels for mailings, they select the ADD option (step 150, FIG. 8), which initiates a program module which operates basically according to the flow diagram in FIG. 8. A list or menu of the types of mail available then appears on the screen, from which the user can select the type of mailing required (step 152), for example certified, registered insured or registered uninsured, and/or COD. A menu then appears giving the user an opportunity to enter any special conditions (step 154), for example a fixed mailing weight where all the letters or packages to be mailed will be of the same weight. Other "special conditions" include an option to select restricted delivery and/or to show to whom the article was delivered, date, and addressee's address, each of which include an additional postage charge which will be stored in the table of postage fees in the computer data base. If either of these options are requested, the appropriate boxes on the return postcard must be checked manually after the forms have been prepared.

At this point the user can enter a list of names and addresses to which items or packages are to be mailed. This can be done either manually at the keyboard, or by retrieval from a database of names either stored in the system or in a remote computer linked to the on site computer via modem or other linkage. The selection of manual entry or data base access is made at step 156. If the user opts not to use the "SIDE FILE" option, they are asked to enter the names and addresses at the keyboard (step 157), and on completion are returned to the main, or initial, menu. Upon entering each record, the user also enters the weight (unless a standard weight has been entered previously), the "postal value" for registered mail, which is the declared value to the postal service by the shipper, the full value (registered mail only), which is the actual value of the item to the shipper, and defaults to the postal value if no entry is made, and the commercial insurance value (registered mail only), which defaults to the difference between the full value and the postal value. The entry of these values will trigger the calculation of the appropriate postage fee for this particular entry from tables available in the data base. After all the entries for a particular addressee have been made, the user can repeat the procedure for all other names and addresses to which items are to be mailed. The user can enter a file number for each entry made to identify that entry. The computer stores all the entered information and calculated postal fees for each addressee automatically. Optionally, the system may be configured to receive input from a postal weighing scale automatically.

If the user opts to use the "SIDE FILE" option, they will be pulling names and addresses previously stored in coded files in the system. These include single name files for an address to which items are repeatedly sent, and group name files for groups of addressee's to which items are often sent. The user selects whether a group of different names and addresses are to be used (step 158), or a number of different packages are to be mailed to the same name and address (step 160). In each case, they are then asked to enter the code to access the appropriate list of names and addresses or single name and address in the data base (steps 162,164). In the case of a single name, the user also enters the number of repetitions (step 166), in other words how many separate items are to be mailed to the same address. In each case, the user is given an opportunity to review the names and addresses, and at this point must add the postal value or weight as well as the actual value of the item(steps 168,170). Once this procedure is complete, the user is returned to the main menu.

Figure 11:
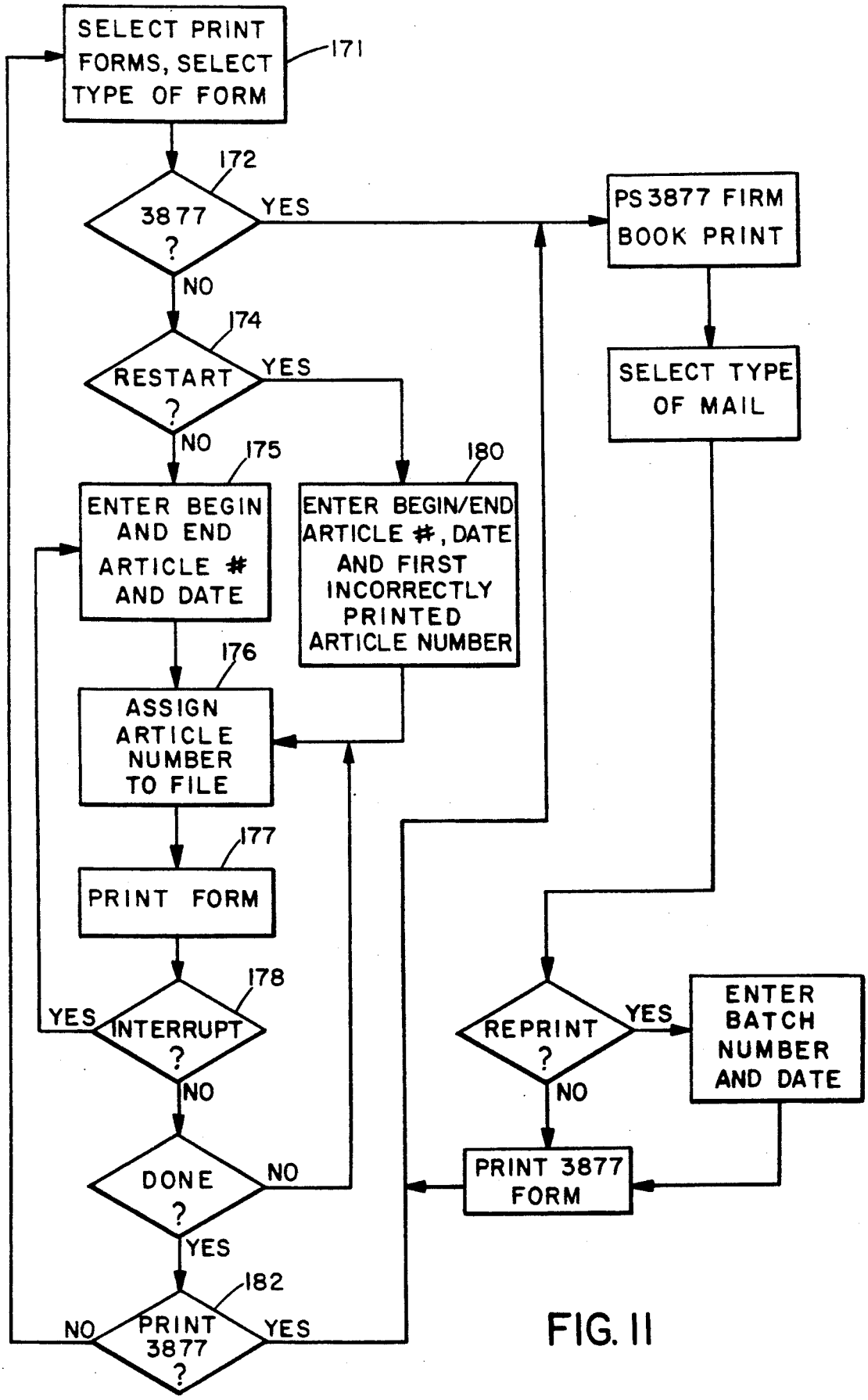
Figure 12:
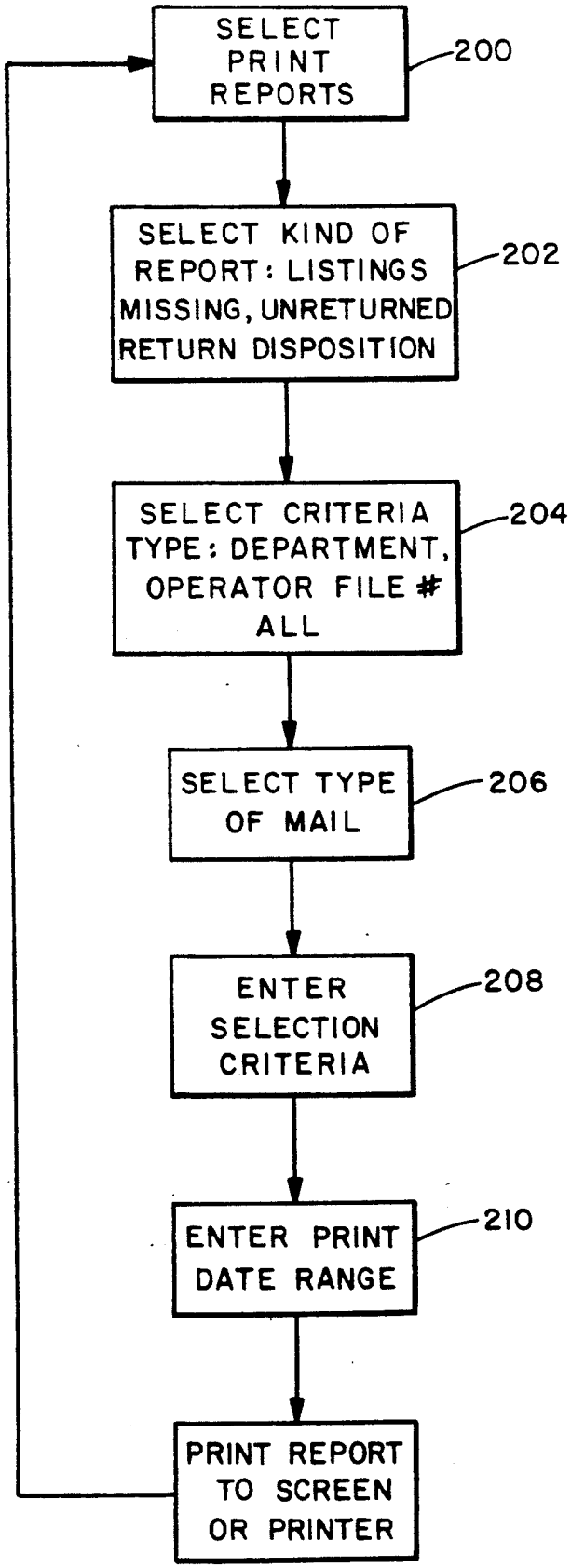

At this point, the user will normally select the PRINT option from the main menu. The user is then given the option of selecting from two different print procedures, known as PRINT FORMS or PRINT REPORTS. FIG. 11 is a flow diagram illustrating the procedure for printing forms, initiated by selection of the PRINT FORM option (step 171). The system is able to print two types of forms. The first type is the actual mailing form which may be a continuous mailing form as described above in connection with FIGS. 2 to 7. The user can select from certified, registered insured, registered uninsured, or COD mailing forms, as well as a report form which is an approved facsimile of the form required by the Post Office for recording certified and registered mailings, which is known as Form PS3877 (Firm Mailing Book). The system automatically prepares this form from the records stored in its memory, as will be explained in more detail below. At step 172, the user selects whether mailing forms or form 3877 are to be prepared. Where a series of mailing forms is to be prepared from the previously prepared list of names and addresses, the user is asked whether this is a restart of the printing cycle, which occurs if the supply of mailing forms was insufficient to complete the list of names, or if the forms came off track(step 174). The restart option is used when something went wrong in the printing or there are insufficient forms in the supply or box to cover all the names and addresses listed. If it is not a restart, the user first enters the beginning article number printed on the first form in the supply in front of the printhead (step 175). They are then asked to enter the end article number. This is only needed where there are insufficient forms in the supply to prepare forms for all items to be mailed. If the operator surmises that the supply is ample to complete the printing cycle, they simply enter P999 or R999. If there are insufficient forms in the supply, the user enters the end article number in the supply (which is printed on the box). The system then assigns each article number successively to the names, or files, in the list (step 176) and prints the forms with the addressee information, the date, the department code, and operator/unit code at the bottom of each individual form part(step 177). The system will then have a complete record for each name and address to which an item is to be mailed of the article identification number (e.g. the registered or certified mail number), the mailing date, and the postal value. If there is a print interrupt (step 178) as a result of there being insufficient forms in the supply to complete the required number of forms to be printed, or the forms coming off track, or some other problem, the system returns to step 174 and the user selects the restart option and re-loads the printer unit with a new supply of forms, which may not be numbered consecutively with the previous supply. At step 180, they enter the beginning and end article numbers of the new supply, the date, and the first "incorrectly printed" article number of the previous supply. The system then returns to step 176, assigning the newly entered article numbers consecutively to the remaining names in the list and storing the information before printing the remaining forms needed to complete the list. If desired, the user may elect to print a sample form prior to initiating the full printing cycle to check form alignment.

At this point the user is asked whether or not a Form 3877 is to be printed (step 182). If not, the system returns to the main menu. If the form is required, and only a single printer is in use, the continuous mailing forms must be removed and replaced with standard blank continuous form paper. The system then prepares a listing of the addressee's for whom mailing labels have just been printed along with the respective article numbers and previously obtained or computed postage fees, values, and so on, on an approved facsimile of the required U.S. Postal Service form. An example of the information provided on the form is given below in Table 2.

The user then simply takes each of the prepared mailing forms, peels off the mailing and article number labels and sticks them to the item or package, tears off and discards the side ends of the form along tear lines 41 and 50, and affixes the green return postcard to the package via the adhesive strips 56, 58. No manual filling in of any information is required, unless the boxes for restricted delivery or a showing of the person to whom the item is delivered must be checked, and the procedure is very quick and convenient.

The system also allows tracking of all mailings. When the return postcard, or any other type of return, for a particular item is received by the sender, they select the option RETURNS from the main menu (see step 190, FIG. 10). They are then asked to enter the article number (step 191). If an incorrect article number is entered, the user can escape and retry via step 192. If the article number entered cannot be found in the computer's memory (step 194), the user is given an opportunity to try again. If the article number is found, the user is asked to enter the return status (step 196). There are several types of return which are possible, including return of the postcard either signed or unsigned, or return of the package unclaimed or incorrectly addressed. The user has the facility to program in predetermined "return codes" which are automatically accessible on entering returns. For example, the user might elect to use "S" for forms which are returned signed, "U" for unclaimed returns, and so on. After entering the type of return, the user enters the date received (step 198). This information is then stored in the appropriate file for preparation of future reports. This procedure is repeated for all the returns received at any particular time.

TABLE 2

HALZ POSTAL SOLUTIONS
1139 S. MISSION RD. SUITE C
FALLBROOK, CA 92028

PAGE:1
TYPE OF MAILING: REGIST. MAIL W/INSURANCE
DATE:08/24/89 BATCH: 1 PS FORM 3877

| ARTICLE NUMBER | NAME, STREET & P.O. ADDRESS | POST-AGE | FEES | R.R. FEES | ACTUAL VALUE REMARKS |
|---|---|---|---|---|---|
| R100200101 | EDWARD FINNEY<br>345 E ST<br>NEW YORK, NY 99999 | 0.25 | 5.25 | 0.90 | 1000.00 |
| R100200102 | MADELINE KAHN<br>1234 COLUMBUS CIRCLE<br>NEW YORK, NY 99999 | 0.25 | 6.05 | 0.90 | 3000.00 |
| R100200103 | BILL WILLIAMS<br>76 U ST<br>CHICAGO, IL 99999 | 0.25 | 4.85 | 0.90 | 170.00 |
| | TOTALS: | 0.75 | 16.15 | 2.70 | |

| TOTAL # OF PIECES LISTED BY SENDER | TOTAL # OF PIECES RECEIVED AT POST OFFICE | POSTMASTER, PER: (NAME OF RECEIVING EMPLOYEE) | THE FULL DECLARATION OF VALUE IS REQUIRED ON ALL DOMESTIC AND INTERNATIONAL REGISTERED MAIL. THE MAXIMUM INDEMNITY PAYABLE IS $25,000 FOR REGISTERED MAIL. |
|---|---|---|---|
| 3 | | | |

The operator is able to obtain a variety of tracking or "return disposition" reports to provide vital information as to the nature of deliveries and the efficiency of the delivery system. Reports are obtained by first selecting the PRINT option from the main menu, and then selecting the "PRINT REPORTS" option (step 200, FIG. 12). The user then selects the type of report desired from a menu of available options (step 202), including listings, missing, unreturned, return disposition, and so on. These reports can all be prepared by the system from the data stored in its data base, which includes files of names and addresses along with the mailing dates, postal values, type of mail, and article numbers. The "Listing" reports allow listings of all files meeting user selected criteria (steps 204 to 210), such as date to date, department, operator, operator generated file numbers, and so on. It can also provide a listing of all files scheduled to be mailed. The return report lists all files for which returns have been received, sorted into groups based on the return code. If any return has been entered for a specific article, this information will also be available. Thus, if the user asks for a report of only those items for which no return card has yet been received, known as a "MISSING" report, the system will print a list of those items in chronological order, so that the user can immediately see the oldest mailings for which no return card has arrived and for which some further action might need to be taken. Postage fee detail reports can also be prepared for accounting purposes, for example. Other reports available include all name listing reports, and return disposition reports. Custom reports can be designed according to the needs of a particular user, for example .

Figure 9:
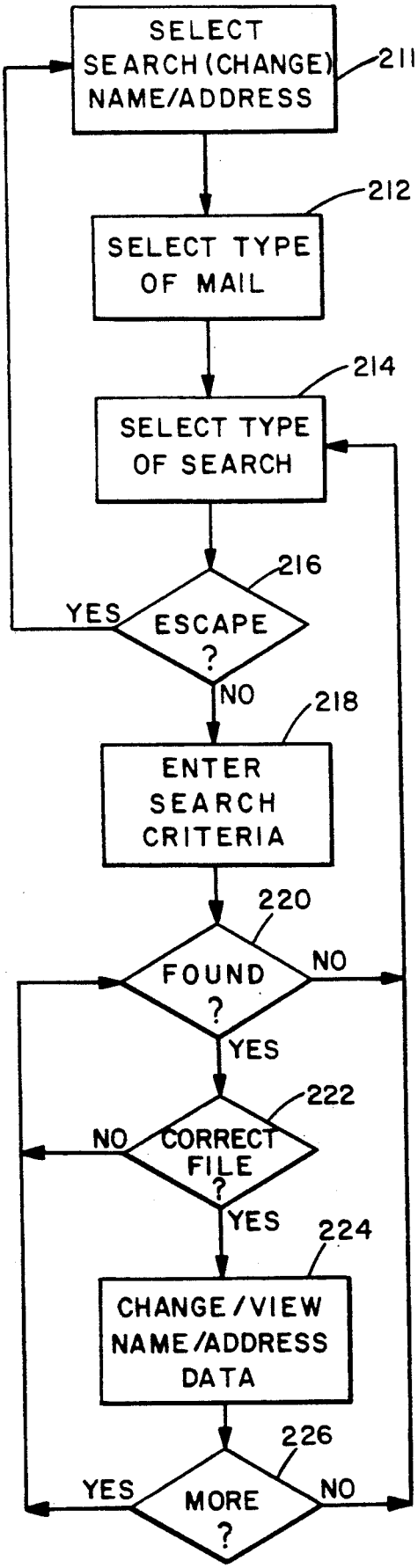
Figure 10:
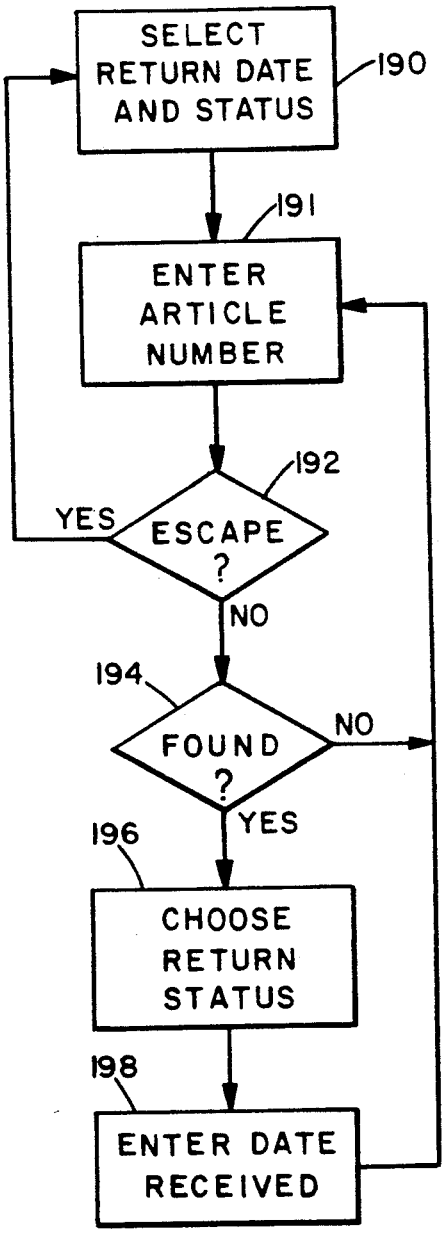

Another option provided on the main menu is SEARCH. The flow diagram for this option is illustrated in FIG. 9. This option is used, for example, when the user wants to look up and review all the data for a particular mailing record on the screen, or wishes to edit a record. The procedure is initiated by selecting SEARCH at the main menu (step 211). The user selects the type of mail (e.g. certified, registered, etc.) (step 212), and then enters the type of search from a series of menu options, which are searches by name, file number, article number, or department (step 214). If an error is made here, the operator can escape at step 216. The operator then enters the search criteria at step 218. For example, if a name search has been requested, the operator enters either a complete name or the first few digits of a name. In the latter case, all names on file starting with the entered digits will appear on the screen, and the operator can scroll through them until the required entry is reached. When an entry or record is found (step 220), the operator is asked if it is the correct one(step 222). If not, the search is continued (scrolling through the records). When the desired record is reached, the operator either views the record or changes it if desired (step 224). If the next record in a series is desired, the operator enters Y or YES at the "more ?" prompt (step 226), and the system continues to scroll down. If a search is completed, the operator enters N or NO at this point and the system returns to the initial search menu, where the user can elect to return to the main menu.

The final option available at the main menu is UTILITIES which enables system functions such as adding, changing or deleting code files, names and addresses, and return codes. The flow diagram for this option is illustrated in FIGS. 13 and 14. Once UTILITIES has been selected at the main menu (step 230), the user selects from a series of available functions as illustrated in FIG. 13, including CODES (step 232), for initially entering or making changes to the side file codes containing repeatedly used names and addresses, RETURNS, (step 233) for entering or changing the return disposition codes, INDEX (step 234), for re-indexing the system, DELETE (step 236) for deleting files, and PARAMETERS (step 238), for entering or changing company data.

Selection of CODES from the utilities menu enables creation of one or more codes of a maximum of 8 digits for either an individual record or group of records attached to a common code. The records entered here are known as side files and can be pulled off the shelf as needed when adding files in the ADD mode.

Selection of the RETURNS option allows creation or changing of return codes which can be of up to 3 digits. The respective codes are entered (step 240) along with a description or explanation of each code, and are used when entering returns under the RETURNS option of the main menu.

The INDEX option is a software maintenance feature which reindexes files and puts them back in order. This feature is used whenever a new set of software is entered or whenever the system cannot find a file.

The DELETE option is used when an individual file is no longer needed on the system. The procedure for deleting files is illustrated in more detail in the flow diagram of FIG. 14. A file can be deleted in one of two ways, either by article number or by date mailed. A number of options appear on the screen. If the first option, "MARK FILES FOR DELETION" is selected(244), the operator then enters the date or article number of each file to be deleted (step 245). The operator then selects "LIST" (248) to provide either an on screen or printed list of the files marked for deletion (step 250). The SAVE option (252) is used where some or all of the marked files are to be "undeleted". The operator enters the article numbers to be saved in step 254. Finally, the DELETE option (256) is selected when all previous steps are completed and the operator is sure that the files marked for deletion are correct. The marked records will be deleted (258) and the available memory space increased accordingly.

PARAMETERS is used to initially enter or change the company data, which will comprise the shipper's name and address appearing on form 3877.

The continuous mailing form described above is easy and convenient to use with a minimum of paperwork. When used in conjunction with the automated mail preparation, record keeping, and tracking system as described above, the manual work necessary in any mail room will be dramatically decreased, reducing expense. Additionally, information can be retrieved quickly and easily at any time, and useful reports can be automatically obtained without tedious manual sorting of copious mail records. The system is extremely easy and convenient to use, requiring only minimal input from the operator.

Although a preferred embodiment of the invention has been described above by way of example only, it will be understood by those skilled in the field that modifications may be made to the disclosed embodiment without departing from the scope of the invention, which is defined by the appended claims.

We claim:

1. A continuous mailing form assembly, comprising: at least one sheet of individual form parts secured together along spaced transverse tear lines, the sheet having opposite outer marginal side edges;

the sheet having lines of pin feed perforations along said opposite outer marginal side edges;

each individual form part having spaced longitudinal tear lines for separating a predetermined detachable area of the form part from the remainder of the form part for attachment to an item to be mailed, the predetermined detachable area comprising a return postcard having printed indicia on both of its faces including marked areas for receiving predetermined information concerning a mailed item, one of said areas on a first face of said postcard comprising a designated addressee area for receiving the address to which the item is to be mailed;

a blown-on label assembly secured to the designated addressee area on each form part, the assembly comprising a detachable address label for attachment to an item to e mailed and means for duplicating the address printed on the address label on the return postcard;

each form part further including an identifying number label having means for securing it to an item to be mailed, the label being detachably secured to the remainder of the form.

2. The assembly as claimed in claim 1, wherein said at least one sheet comprises a single sheet.

3. The assembly as claimed in claim 1, wherein each blown on label assembly comprises a detachable upper part comprising the address label and a lower part adhesively secured to the addressee area of the respective form part, the lower part comprising means for transferring any information imprinted onto the upper part on the lower part.

4. The assembly as claimed in claim 1, wherein each form part includes an additional detachable area for releasably carrying said identifying number label and secured to one side of said first detachable area along a longitudinal tear line.

5. The assembly as claimed in claim 1, wherein the identifying number labels are numbered consecutively on successive form parts and each identifying number is also imprinted on said return postcard.

6. The assembly as claimed in claim 1, wherein said return postcard has the format and dimensions of a Post Office return postcard for registered or certified mailing.

7. A continuous mailing form assembly, comprising:

a continuous single sheet of individual forms secured together along transverse tear lines, the sheet having opposite outer margin side edge lines of pin feed perforations extending along its opposite outer marginal side edges and spaced longitudinal tear lines for separating at least one predetermined area of each form excluding the marginal side edges from the remainder of that form, said one predetermined area comprising a return postcard for attachment to an item to be mailed and having printed indicia on both of its faces including marked areas for receiving predetermined information concerning a mailed item, one of said areas on one of its faces comprising a predetermined addressee area for receiving the name and address of the addressee to which the item is to be mailed;

each individual form further including a detachable address label and a detachable identifying number label for separately attaching to an item to be mailed.

* * * * *